US012043885B2

(12) United States Patent
Matsuo et al.

(10) Patent No.: US 12,043,885 B2
(45) Date of Patent: Jul. 23, 2024

(54) SEAMLESS STEEL PIPE AND METHOD FOR PRODUCING THE SAME

(71) Applicant: NIPPON STEEL CORPORATION, Tokyo (JP)

(72) Inventors: Daisuke Matsuo, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 643 days.

(21) Appl. No.: 17/253,222

(22) PCT Filed: Jul. 9, 2019

(86) PCT No.: PCT/JP2019/027199
§ 371 (c)(1),
(2) Date: Dec. 17, 2020

(87) PCT Pub. No.: WO2020/013197
PCT Pub. Date: Jan. 16, 2020

(65) Prior Publication Data

US 2021/0269904 A1 Sep. 2, 2021

(30) Foreign Application Priority Data

Jul. 9, 2018 (JP) ..... 2018-129666

(51) Int. Cl.
*C22C 38/50* (2006.01)
*C21D 8/00* (2006.01)
(Continued)

(52) U.S. Cl.
CPC ..... *C22C 38/50* (2013.01); *C21D 8/005* (2013.01); *C21D 8/065* (2013.01); *C21D 9/085* (2013.01);
(Continued)

(58) Field of Classification Search
CPC ..... C21D 2211/005; C21D 2211/008; C21D 6/004
See application file for complete search history.

(56) References Cited

U.S. PATENT DOCUMENTS

2012/0031530 A1 2/2012 Takabe et al.
2012/0328897 A1* 12/2012 Ohe ..... C22C 38/48 420/61
(Continued)

FOREIGN PATENT DOCUMENTS

EP 2565287 A1 3/2013
EP 2832881 A1 2/2015
(Continued)

*Primary Examiner* — Nicholas A Wang
(74) *Attorney, Agent, or Firm* — Greer, Burns & Crain, Ltd.

(57) ABSTRACT

The chemical composition of the seamless steel pipe contains Cr: 15.00 to 18.00% in mass % and satisfies Formulae (1) and (2). Furthermore, in the microstructure, (I) a total volume ratio of ferrite and martensite is 80% or more, with the balance being retained austenite of a volume ratio of 20% or less, (II) the number of intersections $NT_L$ in the L-direction observation field of view is 38 or more and $NT_L/NL$ is 1.80 or more, and further (III) the number of intersections $NT_C$ in the C-direction observation field of view is 30 or more and $NT_C/NC$ is 1.70 or more.

$$156Al+18Ti+12Nb+11Mn+5V+328.125N+243.75C+12.5S \leq 12.5 \quad (1)$$

$$Ca/S \geq 4.0 \quad (2)$$

8 Claims, 4 Drawing Sheets

(51) Int. Cl.

| | |
|---|---|
| ***C21D 8/06*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C21D 2211/001* (2013.01); *C21D 2211/005* (2013.01); *C21D 2211/008* (2013.01)

(56) References Cited

U.S. PATENT DOCUMENTS

2015/0101711 A1* 4/2015 Miyata ..... C22C 38/02
148/506
2017/0369963 A1* 12/2017 Fujimura ..... C22C 38/00

FOREIGN PATENT DOCUMENTS

JP 2013249516 A 12/2013
JP 2016145372 A 8/2016
WO 2010134498 A1 11/2010

* cited by examiner

SEAMLESS STEEL PIPE AND METHOD FOR PRODUCING THE SAME

This is a National Phase Application filed under 35 U.S.C. § 371, of International Application No. PCT/JP2019/027199, filed Jul. 9, 2019, the contents of which are incorporated by reference.

TECHNICAL FIELD

The present invention relates to a seamless steel pipe and a method for producing the same, and more particularly relates to a seamless steel pipe which is suitable for uses in geothermal power generation, or uses in oil-well environments or gas-well environments or the like, and a method for producing the same. Hereinafter, in the present description, oil wells and gas wells are collectively referred to as "oil wells."

BACKGROUND ART

An oil-well steel pipe may be used in an oil well in a high-temperature environment containing carbon dioxide gas and/or hydrogen sulfide gas. In the present description, the high-temperature environment has a temperature of about 150 to 200° C. and contains corrosive gases. Examples of corrosive gas include carbon dioxide gas and/or hydrogen sulfide gas.

Conventionally, as the oil-well steel pipe, 13Cr steel material which contains about 13 mass % of Cr and has excellent carbon dioxide gas corrosion resistance has been used. However, when it is used for an oil well in a high-temperature environment as described above, further corrosion resistance will be required.

Accordingly, 17Cr steel material in which the Cr content is increased to be more than in the 13Cr steel material to about 15 to 18% has been proposed. The 17Cr steel material exhibits excellent corrosion resistance in a high-temperature environment as described above.

Meanwhile, with recent deepening of oil wells, there is a demand for oil-well steel pipes having higher strength than conventional ones. Specifically, an oil-well steel pipe having a high strength of 125 ksi grade (yield strength of 862 MPa or more) is required. Furthermore, recently, oil well development has been carried out in cold regions as well. For an oil-well steel pipe for use in such a deep well in cold regions, not only high strength but also excellent low-temperature toughness are required.

Japanese Patent Application Publication No. 2013-249516 (Patent Literature 1), Japanese Patent Application Publication No. 2016-145372 (Patent Literature 2), and International Application Publication No. WO2010/134498 (Patent Literature 3) each propose an oil-well steel pipe which is for use in a high-temperature environment as described above, and has high strength, or high strength and high low-temperature toughness.

The chemical composition of a high-strength stainless steel seamless pipe for oil wells proposed in Patent Literature 1 consists of, in mass %, C: 0.005 to 0.06%, Si: 0.05 to 0.5%, Mn: 0.2 to 1.8%, P: 0.03% or less, S: 0.005% or less, Cr: 15.5 to 18.0%, Ni: 1.5 to 5.0%, V: 0.02 to 0.2%, Al: 0.002 to 0.05%, N: 0.01 to 0.15%, O: 0.006% or less, further containing one or more kinds selected from Mo: 1.0 to 3.5%, W: 3.0% or less, and Cu: 3.5% or less so as to satisfy Formulae (1) and (2), with the balance being Fe and unavoidable impurities. The microstructure of the above described high-strength stainless steel seamless pipe for oil wells is composed of martensite as a main phase, and 10 to 60% of ferrite and 0 to 10% of austenite in volume ratio as a second phase. Further, in the above described microstructure, a GSI value, which is defined as the number of ferrite-martensite grain boundaries existing per unit length of a line segment drawn in a wall thickness direction, is 120 or more at a center position of wall thickness. Furthermore, the wall thickness of the high-strength stainless steel seamless pipe for oil wells is more than 25.4 mm. Here, Formula (1) is defined by $Cr+0.65Ni+0.60Mo+0.30W+0.55Cu-20C \geq 19.5$, and Formula (2) is defined by $Cr+Mo+0.50W+0.30Si-43.5C-0.4Mn-Ni-0.3Cu-9N \geq 11.5$.

In Patent Literature 1, a starting material having the above described chemical composition is produced by hot rolling including piercing-rolling. And, in the hot rolling, a total rolling reduction ratio in a temperature range of 1100 to 900° C. is set to 30% or more. It is stated that this makes it possible to produce a high-strength stainless steel seamless pipe for oil wells having the above described micro-structure. Note that the hot rolling in the temperature range of 1100 to 900° C. corresponds to hot rolling not in a piercing-rolling step using a piercing-rolling mill, but in a elongating-rolling step by a mandrel mill or the like after the piercing-rolling step.

In the method for producing a seamless steel pipe proposed in Patent Literature 2, a steel starting material having a chemical composition which includes, in mass %, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Cu: 3.5% or less, Mo: 1 to 3.5%, V: 0.02 to 0.2%, Al: 0.002 to 0.05%, N: 0.01 to 0.15%, and O: 0.006% or less, satisfies the same Formulae (1) and (2) as in Patent Literature 1, and further contains one or more kinds selected from Nb: 0.2% or less, Ti: 0.3% or less, and Zr: 0.2% or less, with the balance being Fe and unavoidable impurities is prepared. Then, heating of the steel starting material when subjecting the steel starting material to a pipe starting material machining and hot working is performed under a condition that temperature is less than a temperature T(K) defined by Formula (3). Here, Formula (3) is defined by $T(K)=7650/\{2.35-\log_{10}([C]\times\alpha[X])\}$. In Formula (3), [C] is substituted by the C content (mass %), [X] is substituted by the content (mass %) of an element X, which is the largest in content (mass %) among V, Ti, Nb, and Zr, and a is a coefficient, which is substituted by 2 when the element X is V or Ti, and substituted by 1 when the element X is Nb or Zr.

Patent Literature 2 states that the above described production method enables refining of ferrite and, as a result, improvement of low-temperature toughness of the seamless steel pipe.

A stainless steel for oil wells proposed in Patent Literature 3 has: a chemical composition consisting of, in mass %, C: 0.05% or less, Si: 0.5% or less, Mn: 0.01 to 0.5%, P: 0.04% or less, S: 0.01% or less, Cr: more than 16.0 to 18.0%, Ni: more than 4.0 to 5.6%, Mo: 1.6 to 4.0%, Cu: 1.5 to 3.0%, Al: 0.001 to 0.10%, and N: 0.050% or less, with the balance being Fe and impurities, and satisfying Formulae (1) and (2); a micro-structure which includes martensite and 10 to 40% in volume ratio of ferrite, and in which, when a plurality of virtual line segments each having a length of 50 μm from the surface of the stainless steel in the thickness direction and arranged in a row at a pitch of 10 μm in a range of 200 μm are disposed on a cross section of the stainless steel, the ratio of the number of virtual line segments that intersect ferrite to the total number of virtual line segments is more than 85%; and a 0.2% offset yield stress of 758 MPa or more.

Here, Formula (1) is defined as Cr+Cu+Ni+Mo≥25.5, and Formula (2) is defined as −8≤30(C+N)+0.5Mn+Ni+Cu/2+8.2−1.1(Cr+Mo)≤−4.

In the stainless steel for oil wells of Patent Literature 3, ferrite in the structure of an outer layer is controlled. Specifically, in the production process, hot working is performed using a steel starting material having the above described chemical composition. In the hot working, a total reduction of area in a range of 850 to 1250° C. is made 50% or more. When considering the total reduction of area in a range of 850 to 1250° C., not only the reduction of area in piercing-rolling, but also the reduction of area in elongating and rolling is included.

CITATION LIST

Patent Literature

Patent Literature 1: Japanese Patent Application Publication No. 2013-249516

Patent Literature 2: Japanese Patent Application Publication No. 2016-145372

Patent Literature 3: International Application Publication No. WO2010/134498

SUMMARY OF INVENTION

Technical Problem

It is stated that both of the seamless steel pipes according to Patent Literatures 1 and 2 are excellent in low-temperature toughness. However, both of yield strengths of these literatures is less than 862 MPa. In Patent Literatures 1 and 2, no study has been made on a seamless steel pipe which has a yield strength of 862 MPa or more and is excellent in low-temperature toughness. Further, regarding the stainless steel for oil wells according to Patent Literature 3, no study has been made from a viewpoint of low-temperature toughness.

It is an object of the present disclosure to provide a seamless steel pipe which can achieve a yield strength of 862 MPa or more and excellent low-temperature toughness at the same time.

Solution to Problem

A seamless steel pipe according to the present disclosure has a chemical composition consisting of:

in mass %,
C: 0.050% or less,
Si: 0.50% or less,
Mn: 0.01 to 0.20%,
P: 0.025% or less,
S: 0.0150% or less,
Cu: 0.09 to 3.00%,
Cr: 15.00 to 18.00%,
Ni: 4.00 to 9.00%,
Mo: 1.50 to 4.00%,
Al: 0.040% or less,
N: 0.0150% or less,
Ca: 0.0010 to 0.0040%,
Ti: 0.020% or less,
Nb: 0.020% or less,
V: 0 to 0.20%,
Co: 0 to 0.30%,
W: 0 to 2.00%, and
the balance: Fe and impurities, and satisfying Formulae (1) an (2), wherein when a pipe axis direction of the seamless steel pipe is defined as an L direction, a wall thickness direction of the seamless steel pipe is defined as a T direction, and a direction perpendicular to the L direction and the T direction is defined as a C direction, a microstructure satisfies the following (I) to (III):

(I) The microstructure consists of, in total volume ratio, 80% or more of ferrite and martensite, with the balance being retained austenite;

(II) In an L-direction observation field of view of a square shape which is located at a center position of wall thickness of the seamless steel pipe, and whose side extending in the L direction is 100 μm long and whose side extending in the T direction is 100 μm long, when four line segments which extend in the T direction and which are arranged at equal intervals in the L direction and divide the L-direction observation field of view into five equal parts in the L direction are defined as line segments $T_L$1 to $T_L$4, four line segments which extend in the L direction and which are arranged at equal intervals in the T direction and divide the L-direction observation field of view into five equal parts in the T direction are defined as line segments L1 to L4, and an interface between the ferrite and the martensite is defined as a ferrite interface, a number of intersections $NT_L$ which is a number of intersections between line segments $T_L$1 to $T_L$4 and the ferrite interface is 38 or more, and a number of intersections NL, which is a number of intersections between the line segments L1 to L4 and the ferrite interface, and the number of intersections $NT_L$ satisfy Formula (3);

(III) In a C-direction observation field of view of a square shape which is located at the center position of wall thickness of the seamless steel pipe, and whose side extending in the C direction is 100 μm long and whose side extending in the T direction is 100 μm long, when four line segments which extend in the T direction and which are arranged at equal intervals in the C direction and divide the C-direction observation field of view into five equal parts in the C direction are defined as line segments $T_C$1 to $T_C$4, and four line segments which extend in the C direction and which are arranged at equal intervals in the T direction and divide the C-direction observation field of view into five equal parts in the T direction are defined as line segments C1 to C4, a number of intersections $NT_C$ which is the number of intersections between line segments $T_C$1 to $T_C$4 and the ferrite interface is 30 or more, and a number of intersections NC which is the number of intersections between the line segments C1 to C4 and the ferrite interface, and the number of intersections $NT_C$ satisfy Formula (4):

$$156Al+18Ti+12Nb+11Mn+5V+328.125N+243.75C+12.5S\leq 12.5 \quad (1)$$

$$Ca/S\geq 4.0 \quad (2)$$

$$NT_L/NL\geq 1.80 \quad (3)$$

$$NT_{=C}/NC\geq 1.70 \quad (4)$$

where, each symbol of element in Formulae (1) and (2) is substituted by the content (mass %) of a corresponding element.

A method for producing a seamless steel pipe according to the present disclosure includes:

a heating step for heating a starting material having a chemical composition consisting of:

in mass %,

C: 0.050% or less,

Si: 0.50% or less,

Mn: 0.01 to 0.20%,

P: 0.025% or less,

S: 0.0150% or less,

Cu: 0.09 to 3.00%,

Cr: 15.00 to 18.00%,

Ni: 4.00 to 9.00%,

Mo: 1.50 to 4.00%,

Al: 0.040% or less,

N: 0.0150% or less,

Ca: 0.0010 to 0.0040%,

Ti: 0.020% or less,

Nb: 0.020% or less,

V: 0 to 0.20%,

Co: 0 to 0.30%,

W: 0 to 2.00%, and the balance: Fe and impurities, and satisfying Formulae (1) and (2) at a heating temperature T of 1200 to 1260° C. for t hours;

a piercing-rolling step for piercing-rolling the starting material which has been heated in the heating step under a condition satisfying Formula (A) to produce a hollow shell;

a elongating-rolling step for elongating and rolling the hollow shell;

a quenching step for quenching the hollow shell after the elongating-rolling step at a quenching temperature of 850 to 1150° C.; and a tempering step for tempering the hollow shell after the quenching step at a tempering temperature of 400 to 700° C., $$156Al+18Ti+12Nb+11Mn+5V+328.125N+243.75C+12.5S\leq 12.5 \quad (1)$$

$$Ca/S\geq 4.0 \quad (2)$$

$$0.057X-Y<1720 \quad (A)$$

where, X in Formula (A) is defined by the following Formula (B), $$X=(T+273)\times\{20+\log(t)\} \quad (B)$$

where, T is a heating temperature (° C.) of the starting material, and t is a holding time (hour) at the heating temperature T, an area reduction ratio Y (%) in Formula (A) is defined by Formula (C):

$$Y=\{1-(\text{cross sectional area perpendicular to pipe axis direction of hollow shell after piercing-rolling}/\text{cross sectional area perpendicular to pipe axis direction of starting material before piercing-rolling})\}\times 100 \quad (C)$$

Advantageous Effects of Invention

A seamless steel pipe according to the present disclosure can achieve a yield strength of 862 MPa or more and excellent low-temperature toughness at the same time. The method for producing a seamless steel pipe according to the present disclosure enables production of the above described seamless steel pipe.

DESCRIPTION OF EMBODIMENTS

The present inventors have studied on a seamless steel pipe which can achieve a yield strength of 862 MPa or more and excellent low-temperature toughness at the same time.

First, the present inventors have studied on the chemical composition of a seamless steel pipe having a yield strength of 862 MPa or more and excellent low-temperature toughness. As a result, the present inventors have considered that a seamless steel pipe having a chemical composition consisting of, in mass %, C: 0.050% or less, Si: 0.50% or less, Mn: 0.01 to 0.20%, P: 0.025% or less, S: 0.0150% or less, Cu: 0.09 to 3.00%, Cr: 15.00 to 18.00%, Ni: 4.00 to 9.00%, Mo: 1.50 to 4.00%, Al: 0.040% or less, N: 0.0150% or less, Ca: 0.0010 to 0.0040%, Ti: 0.020% or less, Nb: 0.020% or less, V: 0 to 0.20%, Co: 0 to 0.30%, W: 0 to 2.00%, and the balance: Fe and impurities can possibly achieve a high yield strength of 862 MPa (125 ksi) or more and excellent low-temperature toughness at the same time.

Meanwhile, in the case of the seamless steel pipe having the above described chemical composition, the microstructure is a duplex micro-structure which is dominantly composed of ferrite and martensite. More specifically, the microstructure contains ferrite and martensite, with the balance being retained austenite.

The present inventors investigated the relationship between the volume ratios of ferrite and martensite in a duplex micro-structure and low-temperature toughness. The present inventors further investigated and studied the relationship between distribution state of ferrite and martensite of a duplex micro-structure and low-temperature toughness as well. As a result, it has been found that in the duplex micro-structure of the steel material having the above described chemical composition, even if the ferrite volume ratio and the martensite volume ratio are equal, if the distribution state of ferrite and martensite differs, low-temperature toughness expected to be obtained will be quite different.

Figure 1:
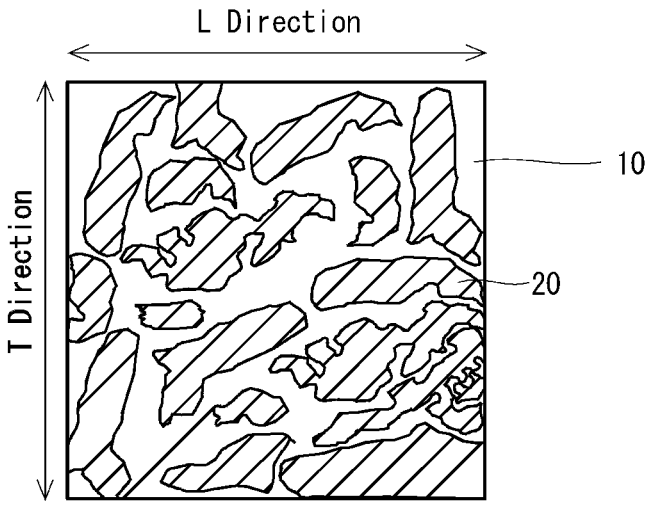
FIG. 1 is a schematic view of a microstructure in a cross section located at a center position of wall thickness of a seamless steel pipe and including a pipe axis direction (L direction) and a wall thickness direction (T direction) of the seamless steel pipe, the seamless steel pipe having the same chemical composition as that of the seamless steel pipe of the present embodiment, but having a different microstructure.
Figure 2:
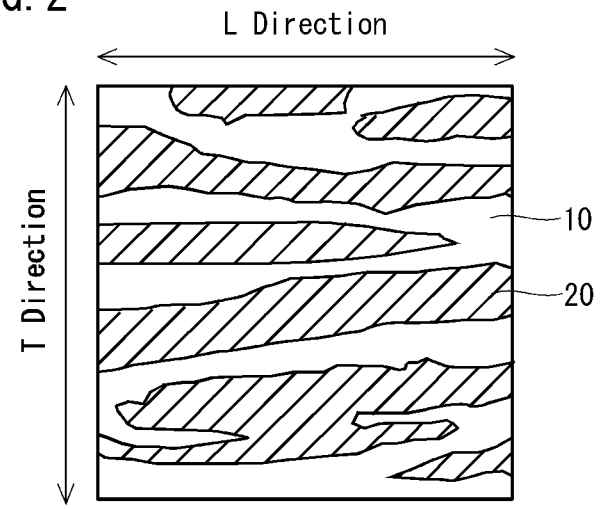
FIG. 2 is a schematic view of the microstructure in a cross section located at a center position of wall thickness of the seamless steel pipe of the present embodiment and including the L direction and the T direction.

FIGS. 1 and 2 are schematic diagrams of a microstructure in a cross section including the pipe axis direction and the wall thickness direction of the seamless steel pipe having the above-described chemical composition. The horizontal direction of FIG. 1 corresponds to the pipe axis direction (rolling direction), and the vertical direction of FIG. 1 corresponds to the wall thickness direction. Similarly, the horizontal direction in FIG. 2 corresponds to the L direction, and the vertical direction in FIG. 2 corresponds to the T direction. In the present description, the pipe axis direction (rolling direction) of the seamless steel pipe is defined as a "L direction". The wall thickness direction of the seamless steel pipe is defined as a "T direction". Here, the wall thickness direction means a radial direction in a cross section perpendicular to the pipe axis direction. A direction perpendicular to the L direction and the T direction (corresponding to the circumferential direction of the seamless steel pipe) is defined as a "C direction". In both FIGS. 1 and 2, the length in the L direction of the schematic diagram is 100 μm, and the length thereof in the T direction is 100 μm.

In FIGS. 1 and 2, a white region 10 is ferrite. A hatched region 20 is martensite. The ferrite volume ratio and the martensite volume ratio in FIG. 1 are not so different from the ferrite volume ratio and the martensite volume ratio in FIG. 2. However, the distribution state of ferrite 10 and martensite 20 in FIG. 1 is significantly different from the distribution state of ferrite 10 and martensite 20 in FIG. 2. Specifically, in the microstructure shown in FIG. 1, ferrite 10 and martensite 20 each extend in random directions, forming a non-layered structure. On the other hand, in the microstructure shown in FIG. 2, ferrite 10 and martensite 20 extend in the L direction, and ferrite 10 and martensite 20 are stacked in the T direction. That is, the microstructure shown in FIG. 2 is a layered structure of ferrite 10 and martensite 20.

In this way, it has been found that in the seamless steel pipe having the above described chemical composition, the microstructure may differ greatly even if the chemical composition is the same. Charpy impact test specimens were taken from the seamless steel pipe having the microstructure shown in FIG. 1 and the seamless steel pipe having the microstructure shown in FIG. 2 by a method described below. Then, a Charpy impact test was carried out in accordance with ASTM A370-18, and absorbed energy (J) at −10° C. was determined. As a result, the absorbed energy at −10° C. of the seamless steel pipe having the microstructure (layered structure) shown in FIG. 2 was remarkably large, compared with the absorbed energy at −10° C. of the seamless steel pipe having the microstructure (non-layered structure) shown in FIG. 1. Therefore, the present inventors considered that in the above-described chemical composition, excellent low-temperature toughness could be obtained if a layered structure extending along the L direction is obtained in the microstructure of a cross section including the L direction and the T direction (hereinafter referred to as an L-direction cross section).

However, a further study has revealed that even if the microstructure of the seamless steel pipe had a layered structure extending along the L direction, the seamless steel pipe did not necessarily have excellent low-temperature toughness. That is, even when the microstructure of the seamless steel pipe had a layered structure extending along the L direction in an L direction cross section, there were cases where low-temperature toughness was poor.

Accordingly, the present inventors studied on the relationship between a propagation direction of a crack in the seamless steel pipe and an extending direction of the layered structure. As a result, it was found that in order to enhance the low-temperature toughness, it is important that the layered structure extends not only in the L direction but also in the C direction. Although the reason for this is not clear, the following reasons are conceivable.

There are cases where a crack in the seamless steel pipe propagates in the L direction and where it propagates in the C direction. Therefore, in order to enhance the low-temperature toughness, it is preferable that propagation of a crack can be inhibited by the martensite in the layered structure no matter whether the crack propagates in the L direction or the C direction.

Figure 3:
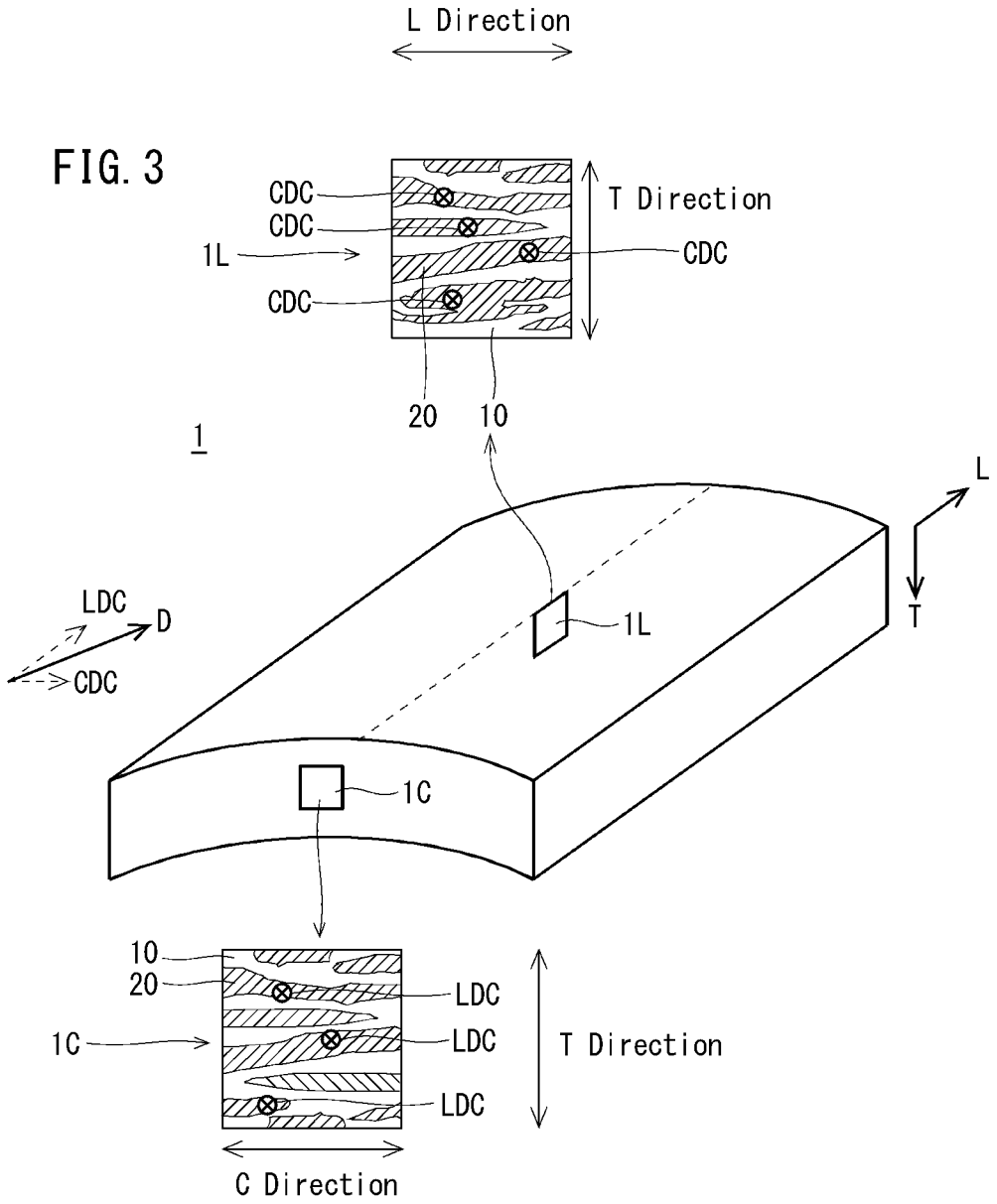
FIG. 3 is a schematic diagram to illustrate a relationship between the microstructure and propagation of a crack in a cross section of the seamless steel pipe.

FIG. 3 is a schematic diagram to illustrate the relationship between the microstructure and the propagation of a crack in a cross section of a seamless steel pipe 1. Referring to FIG. 3, in the seamless steel pipe 1, as described above, a cross section including the L direction and the T direction is defined as a "L-direction cross section 1L." Further, a cross section including the C direction and the T direction is defined as a "C-direction cross section 1C." In FIG. 3, it is assumed that the layered structure extends sufficiently in the L direction and also extends sufficiently in the C direction.

As shown in FIG. 3, a propagation direction D of a crack is decomposed into an L direction component and a C direction component. The L direction component of the propagation direction of a crack is defined as LDC (L Direction Crack). The C direction component of the propagation direction of a crack is defined as CDC (C Direction Crack).

In a layered structure composed of ferrite 10 and martensite 20, martensite 20 inhibits the propagation of a crack. That is, martensite 20 has a metal micro-structure finer than that of ferrite 10, and thus has a micro-structure having excellent toughness. Therefore, martensite 20 acts as resistance against the propagation of a crack. In a case where the propagation direction of a crack intersects with the extending direction of martensite 20, and even if a crack tip that has collided with martensite 20 changes its propagation direction and starts propagating again, the crack tip is likely to collide with martensite 20 again, that is, in a case where a crack can hardly avoid martensite 20 no matter in which way it propagates, it is possible to effectively inhibit the propagation of a crack.

As shown in the microstructure of the C-direction cross section 1C in FIG. 3, an L direction component LDC of a crack intersects (crosses at right angles) with the martensite 20 extending in the C direction. In this case, martensite 20 extending in the C direction acts as resistance against the L direction component LDC of a crack and inhibits the propagation of the L direction component LDC of a crack.

Similarly, as shown in the microstructure of the L-direction cross section 1L of FIG. 3, a C direction component CDC of crack intersects (crosses at right angles) with martensite 20 extending in the L-direction. In this case, the martensite extending in the L direction acts as resistance against the C direction component CDC of a crack and inhibits the propagation of the C direction component CDC of a crack.

As described above, the martensite extending in the C direction and the L direction inhibits the propagation of a crack. Further, in the L-direction cross section 1L and the C-direction cross section 1C, as the number of stacked layers in the T-direction per unit area increases, it becomes more difficult that a crack propagates avoiding martensite 20. Specifically, as the number of stacked layers in the T direction per unit area in the L-direction cross section 1L and the C-direction cross section 1C increases, it is more likely that even if a crack which has been once stopped propagating by martensite 20 changes its propagation direction and starts propagating again, the crack tip collides with another martensite 20 immediately. Therefore, the propagation of a crack is inhibited.

As so far described, the more the number of stacked layers of ferrite 10 and martensite 20 in the T direction per unit area of the layered structure in the L-direction cross section 1L is, and the more sufficiently the layered structure is extended in the L direction; and the more the number of stacked layers of ferrite 10 and martensite 20 in the T direction per unit area of the layered structure in the C-direction cross section 1C is, and the more sufficiently the layered structure is extended in the C direction, it becomes more difficult for a crack to avoid martensite 20 than in a case where the layered structure is sufficiently extended only in the L direction and is not sufficiently extended in the C direction. Therefore, it is possible to sufficiently suppress propagation of a crack.

As described so far, the inventors have considered that to effectively suppress the propagation of a crack in the seamless steel pipe 1, it is very effective not only that in the microstructure in the L-direction cross section 1L, the number of stacked layers of ferrite 10 and martensite 20 in the T direction per unit area is large, and martensite 20 is sufficiently extended in the L direction, but also that in the microstructure in the C-direction cross section 1C, the number of stacked layers of ferrite 10 and martensite 20 in the T direction per unit area is large, and martensite 20 is sufficiently extended in the C direction.

Based on results of the above described study, the present inventors further studied not only on the morphology of the layered structure in the L-direction cross section 1L, but also on the morphology of the layered structure in the C-direction cross section 1C. As a result, if, in the L-direction cross section 1L, (II-1) the number of intersections $NT_L$ is 38 or more, and (II-2) the layer index of longitudinal direction $LI_L$ defined by Formula (3) is 1.80 or more, and if, in the C-direction cross section 1C, (III-1) the number of intersections $NT_C$ is 30 or more, and (III-2) the layer index of circumferential direction $LI_C$ defined by Formula (4) is 1.70 or more, it becomes possible to very effectively suppress cracks even if the yield strength is 862 MPa or more, and to achieve excellent low-temperature toughness.

$$\text{Layer index } LI_L = NT_L/NL \geq 1.80 \quad (3)$$

$$\text{Layer index } LI_C = NT_C/NC \geq 1.70 \quad (4)$$

Hereinafter, the number of intersections $NT_L$ and the layer index $LI_L$, and the number of intersections $NT_C$ and the layer index $LI_C$ will be described.

[Number of intersections $NT_L$ and the layer index $LI_L$ in L-direction cross section 1L]

The layer index $LI_L$ is an index indicating the degree of development of layered structure in the L-direction cross section 1L. $NT_L$ and NL in the layer index $LI_L$ are defined as follows.

Figure 4:
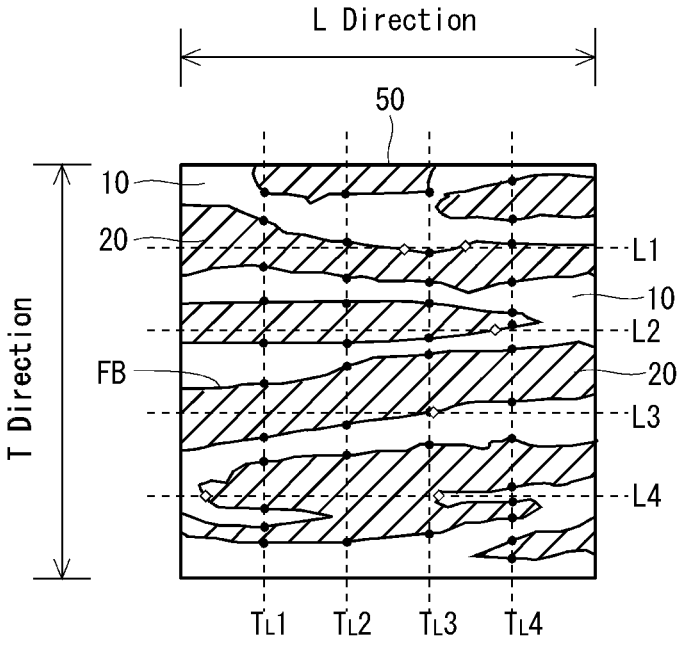
FIG. 4 is a schematic diagram to illustrate a calculation method of a layer index $LI_L$ in an L-direction observation field of view in the present embodiment.

Referring to FIG. 4, in an L-direction cross section 1L including the L direction and the T direction at a center position of wall thickness of the seamless steel pipe, a region of a square shape whose side extending in the L direction is 100 μm long and whose side extending in the T direction is 100 μm long is defined as an L-direction observation field of view 50. In FIG. 4, the L-direction observation field of view 50 includes ferrite 10 and martensite 20. Here, an interface between ferrite 10 and martensite 20 is defined as a "ferrite interface FB." Note that retained austenite exists at a lath interface in martensite 20, and observing it with a microscope is difficult. On the other hand, ferrite 10 and martensite 20 have different contrasts under microscope observation and therefore they can be easily identified by those skilled in the art.

Line segments $T_L$1 to $T_L$4 in FIG. 4 are line segments that extend in the T direction and are arranged at equal intervals in the L direction to divide the L-direction observation field of view 50 into 5 equal parts in the L direction. The number of intersections (marked with "•" in FIG. 4) between the line segments $T_L$1 to $T_L$4 and the ferrite interface FB in the L-direction observation field of view 50 is defined as the number of intersections $NT_L$. The number of intersections $NT_L$means the number of stacked layers of ferrite 10 and martensite 20 in the T direction per unit area in the L-direction cross section 1L (L-direction observation field of view 50).

Line segments L1 to L4 in FIG. 4 are line segments that extend in the L direction and are arranged at equal intervals in the T direction to divide the L-direction observation field of view 50 into 5 equal parts in the T direction. The number of intersections (marked with "◇" in FIG. 4) between the line segments L1 to L4 and the ferrite interface FB in the L-direction observation field of view 50 is defined as the number of intersections NL.

The layer index $LI_L$ means the degree of development of layered structure in the L-direction cross section 1L (L-direction observation field of view 50). When the number of intersections $NT_L$ is 38 or more and the layer index $LI_L$ is 1.80 or more, it means that a sufficiently developed layered structure is obtained in the L-direction cross section 1L. In this case, on the assumption that the number of intersections $NT_C$ in the C-direction cross section 1C (C-direction observation field of view 60) is 30 or more and the layer index $LI_C$ is 1.70 or more, in the seamless steel pipe having the above described chemical composition, a yield strength of 862 MPa or more, and excellent low-temperature toughness have been obtained. Note that, in FIG. 4, the number of intersections $NT_L$ is 43 and the number of intersections NL is 6. Therefore, the layer index $LI_L$ is 7.17.

[Number of intersections $NT_C$ and the layer index $LI_C$ in C-direction cross section 1C]

The layer index $LI_C$ is an index indicating the degree of development of layered structure in the C-direction cross section 1C. $NT_C$ and NC in the layer index $LI_C$ are defined as follows.

Figure 5:
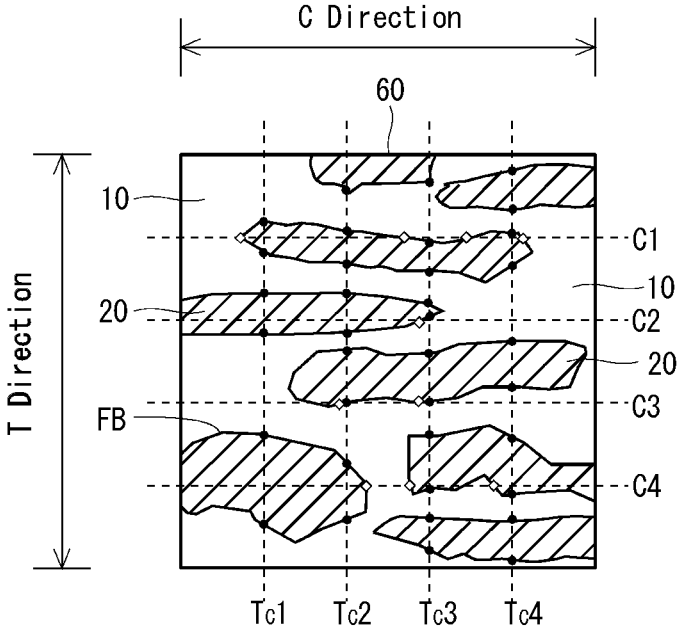
FIG. 5 is a schematic diagram to illustrate the calculation method of a layer index $LI_C$ in a C-direction observation field of view in the present embodiment.

Referring to FIG. 5, in a C-direction cross section 1C including the C direction and the T direction at a center position of wall thickness of the seamless steel pipe, a region of a square shape whose side extending in the C direction is 100 μm long and whose side extending in the T direction is 100 μm long is defined as a C-direction observation field of view 60. As in FIG. 4, the C-direction observation field of view 60 includes ferrite 10 and martensite 20 in FIG. 5.

Line segments $T_C$1 to $T_C$4 in FIG. 5 are line segments that extend in the T direction and are arranged at equal intervals in the C direction to divide the C-direction observation field of view 60 into 5 equal parts in the C direction. The number of intersections (marked with "•" in FIG. 5) between the line segments $T_C$1 to $T_C$4 and the ferrite interface FB in the C-direction observation field of view 60 is defined as the number of intersections $NT_C$. The number of intersections $NT_C$ means the number of stacked layers of ferrite 10 and martensite 20 in the T direction per unit area in the C-direction cross section 1C (C-direction observation field of view 60).

Line segments C1 to C4 in FIG. 5 are line segments that extend in the C direction and are arranged at equal intervals in the T direction to divide the C-direction observation field of view 60 into 5 equal parts in the T direction. The number of intersections (marked with "◇" in FIG. 5) between the line segments C1 to C4 and the ferrite interface FB in the C-direction observation field of view 60 is defined as the number of intersections NC.

The layer index $LI_C$ means the degree of development of layered structure in the C-direction cross section 1C (C-direction observation field of view 60). When the number of intersections $NT_C$ is 30 or more and the layer index $LI_C$ is 1.70 or more, it means that a sufficiently developed layered structure is obtained in the C-direction cross section 1C. In this case, on the assumption that the number of intersections $NT_L$ in the L-direction cross section 1L is 38 or more and the layer index $LI_L$ is 1.80 or more, in the seamless steel pipe having the above described chemical composition, a yield strength of 862 MPa or more, and excellent low-temperature toughness are obtained. Note that, in FIG. 6, the number of intersections $NT_C$ is 36 and the number of intersections NC is 10. Therefore, the layer index $LI_C$ is 3.60.

As described above, not only the number of intersections $NT_L$, which means the number of stacked layers of ferrite 10 and martensite 20 in the T direction per unit area in the L-direction cross section 1L, is set to 38 or more, and the layer index $LI_L$, which means the degree of layered state of ferrite 10 and martensite 20 is set to 1.80 or more (that is, Formula (3) is satisfied), but also the number of intersections $NT_C$, which means the number of stacked layers of ferrite 10 and martensite 20 in the T direction per unit area in the C-direction cross section 1C, is set to 30 or more, and the layer index $LI_C$ indicating the degree of layered state of martensite and ferrite, is set to 1.70 or more (that is, Formula (4) is satisfied). As a result, cracks can be effectively suppressed, and excellent low-temperature toughness can be achieved even if a yield strength is 862 MPa or more.

However, even with the seamless steel pipe having the above described chemical composition, it was found that the layered structure in the L-direction cross section 1L and the C-direction cross section 1C may not always satisfy Formulae (3) and (4). Therefore, the present inventors have studied causes thereof. As a result, the following items were found.

Usually, Ti and Nb are effective in forming carbonitrides and the like during hot working and refining the crystal grains by a pinning effect. In the present description, carbonitrides and the like mean a generic term for nitrides, carbides or carbonitrides.

However, in the production of a seamless steel pipe using a starting material having the above described chemical composition, the pinning effects of Ti and Nb hinder elongation of ferrite. Similarly, Al forms AlN, thereby exhibiting a pinning effect. In addition, V forms V carbonitrides, thereby exhibiting a pinning effect. Further, Mn may combine with S to form fine MnS. In this case, MnS also exhibits a pinning effect. If a large number of precipitates that generate these pinning effects are produced, the elongation of ferrite is hindered. Therefore, it is difficult to obtain a sufficiently developed layered structure in the L-direction cross section 1L and/or the C-direction cross section 1C. As a result, the microstructure does not satisfy Formula (3) and/or Formula (4).

Therefore, the present inventors have studied the relationship among the Ti content, Nb content, Al content, N content, V content, C content, Mn content, and S content in the chemical composition, and the degree of development of layered structure. As a result, it was found that if the above described chemical composition further satisfies Formula (1), the generation of precipitates that exhibit pinning effects (hereinafter referred to as pinning particles) can be sufficiently suppressed, and a sufficiently developed layered structure can be obtained in both the L-direction cross section 1L and the C-direction cross section 1C:

$$156Al+18Ti+12Nb+11Mn+5V+328.125N+243.75C+12.5S\leq 12.5 \quad (1)$$

where, each symbol of element in Formula (1) is substituted by the content (mass %) of a corresponding element.

Further, to obtain a layered structure satisfying Formulae (3) and (4) described above in the seamless steel pipe, it is preferable to improve hot workability during the production process thereof. Accordingly, it is preferable that the above described chemical composition satisfies not only Formula (1) but also the following Formula (2):

$$Ca/S\geq 4.0 \quad (2)$$

where, the element symbol in Formula (2) is substituted by the content (mass %) of the corresponding element.

Dissolved S segregates at grain boundaries and deteriorates hot workability. If S is immobilized by Ca, the dissolved S in steel will be reduced and thereby hot workability can be improved. In the case of the seamless steel pipe having the above described chemical composition, when the Ca content with respect to the S content satisfies Formula (2), sufficient hot workability can be obtained. Therefore, assuming that the chemical composition of the seamless steel pipe also satisfies Formula (1) as well, a layered structure satisfying the above described (II-1) and (II-2) can be obtained in the L-cross section 1L, and further a layered structure satisfying (III-1) and (III-2) is obtained in the C-direction cross section 1C. As a result, cracks can be effectively suppressed, and excellent low-temperature toughness can be achieved even when the yield strength is 862 MPa or more.

Figure 6:
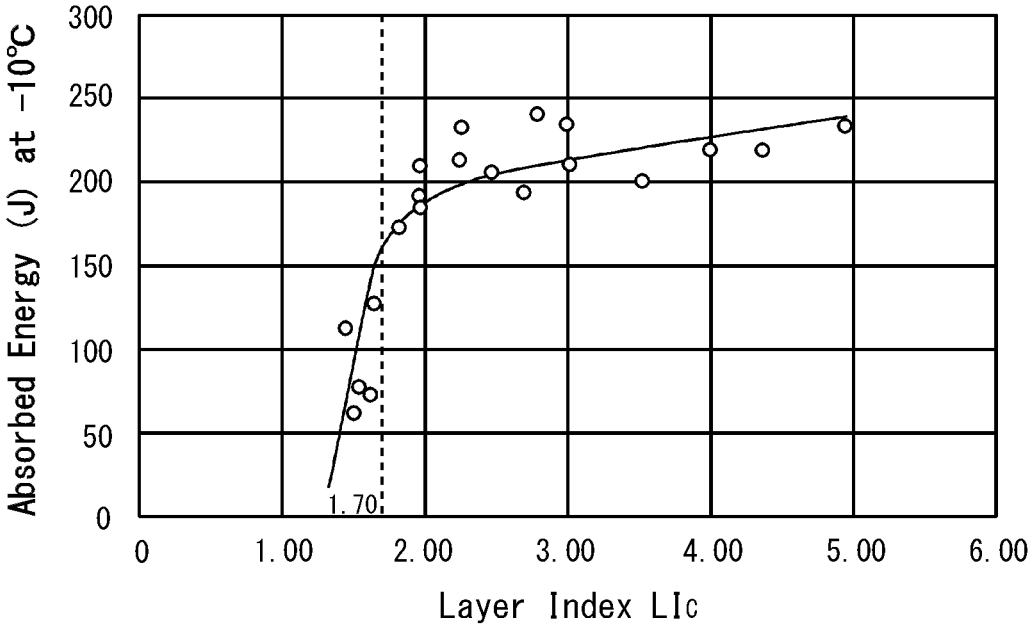
FIG. 6 is a diagram to show a relationship between the layer index $LI_C$ in the C-direction observation field of view and absorbed energy at −10° C. (low-temperature toughness) in the seamless steel pipe, in which the content of each element in the chemical composition is within the above described range and satisfies Formulae (1) and (2), and the layer index $LI_L$ in the L-direction observation field of view satisfies Formula (3).

FIG. 6 is a diagram to show a relationship between the layer index $LI_C$ in the C-direction observation field of view and absorbed energy at −10° C. (low-temperature toughness) in the seamless steel pipe having a chemical composition in which the content of each element is within the above described range and which satisfies Formulae (1) and (2), the number of intersections $NT_L$ in the L-direction observation field of view is 38 or more, the layer index $LI_L$ satisfies Formula (3), and having a yield strength of 862 MPa or more. That is, FIG. 6 is a diagram to show a relationship between the degree of development of layered structure ($LI_C$) in the C-direction cross section 1C and low-temperature toughness in the seamless steel pipe which has a chemical composition that satisfies Formulae (1) and (2), and a yield strength of 862 MPa or more, and in which a sufficiently developed layered structure is obtained in the L-direction cross section 1L.

Referring to FIG. 6, in the seamless steel pipe in which the content of each element in the chemical composition is within the above described range and satisfies Formulae (1) and (2), the above described (II-1) and (II-2) are satisfied in the L-direction observation field of view, and the yield strength is 862 MPa or more, if the layer index $LI_C$ in the C-direction observation field of view is less than 1.70, the absorbed energy at −10° C. sharply increases as the layer index $LI_C$ increases. And when the layer index $LI_C$ becomes 1.70 or more, although the absorbed energy at −10° C. becomes 150 J or more, increase in the absorbed energy at −10° C. associated with increase in the layer index $LI_C$ is less than when the layer index $LI_C$ is less than 1.70. That is, the layer index $LI_C$ has an inflection point in the vicinity of 1.70. Note that in FIG. 6, when the layer index $LI_C$ was 1.70 or more, the number of intersections $NT_C$ was 30 or more.

In short, FIG. 6 shows that in the seamless steel pipe having a yield strength of 862 MPa or more, low-temperature toughness is significantly enhanced not only by the fact that the layered structure is sufficiently developed in the L-direction cross section 1L, but also by the fact that the layered structure is sufficiently developed in the C-direction cross section 1C. Therefore, in the seamless steel pipe in which the content of each element in the chemical composition is within the above described range, and satisfies Formulae (1) and (2), the number of intersections $NT_L$ in the L-direction observation field of view is 38 or more, and the layer index $LI_L$ satisfies Formula (3), by configuring the number of intersections $NT_C$ to be 30 or more, and the layer index $LI_C$ to be 1.70 or more, a yield strength of 862 MPa or more can be obtained, as well as excellent low-temperature toughness can be achieved.

A seamless steel pipe according to the present embodiment which has been completed based on the findings described so far and a method for producing the same has the following configurations.

The seamless steel pipe of [1] has a chemical composition consisting of:

in mass %,

C: 0.050% or less,

Si: 0.50% or less,

Mn: 0.01 to 0.20%,

P: 0.025% or less,

S: 0.0150% or less,

Cu: 0.09 to 3.00%,

Cr: 15.00 to 18.00%,

Ni: 4.00 to 9.00%,

Mo: 1.50 to 4.00%,

Al: 0.040% or less,

N: 0.0150% or less,

Ca: 0.0010 to 0.0040%,

Ti: 0.020% or less,

Nb: 0.020% or less,

V: 0 to 0.20%,

Co: 0 to 0.30%,

W: 0 to 2.00%, and the balance: Fe and impurities, and satisfying Formulae (1) an (2), wherein when a pipe axis direction is defined as an L direction, a wall thickness direction is defined as a T direction, and a direction perpendicular to the L direction and the T direction is defined as a C direction in the seamless steel pipe, the microstructure thereof satisfies the following (I) to (III):

(I) The microstructure consists of, in total volume ratio, 80% or more of ferrite and martensite, with the balance being retained austenite.

(II) In an L-direction observation field of view of a square shape which is located at a center position of wall thickness of the seamless steel pipe, and whose side extending in the L direction is 100 μm long and whose side extending in the T direction is 100 μm long, when four line segments which extend in the T direction and which are arranged at equal intervals in the L direction and divide the L-direction observation field of view into five equal parts in the L direction are defined as line segments $T_L$1 to $T_L$4, four line segments which extend in the L direction and which are arranged at equal intervals in the T direction and divide the L-direction observation field of view into five equal parts in the T direction are defined as line segments L1 to L4, and an interface between the ferrite and the martensite is defined as a ferrite interface, a number of intersections $NT_L$ which is a number of intersections between line segments $T_L$1 to $T_L$4 and the ferrite interface is 38 or more, and a number of intersections NL, which is a number of intersections between the line segments L1 to L4 and the ferrite interface, and the number of intersections $NT_L$satisfy Formula (3).

(III) In a C-direction observation field of view of a square shape which is located at the center position of wall thickness of the seamless steel pipe, and whose side extending in the C direction is 100 μm long and whose side extending in the T direction is 100 μm long, when four line segments which extend in the T direction and which are arranged at equal intervals in the C direction and divide the C-direction observation field of view into five equal parts in the C direction are defined as line segments $T_C$1 to $T_C$4, and four line segments which extend in the C direction and which are arranged at equal intervals in the T direction and divide the C-direction observation field of view into five equal parts in the T direction are defined as line segments C1 to C4, a number of intersections $NT_C$ which is the number of intersections between line segments $T_C$1 to $T_C$4 and the ferrite interface is 30 or more, and a number of intersections NC which is the number of intersections between the line segments C1 to C4 and the ferrite interface, and the number of intersections $NT_C$ satisfy Formula (4):

$$156A1+18Ti+12Nb+11Mn+5V+328.125N+243.75C+12.5S\leq 12.5 \quad (1)$$

$$Ca/S\geq 4.0 \quad (2)$$

$$NT_L/NL\geq 1.80 \quad (3)$$

$$NT_C/NC\geq 1.70 \quad (4)$$

where, each symbol of element in Formulae (1) and (2) is substituted by the content (mass %) of a corresponding element.

A seamless steel pipe of [2] is the seamless steel pipe according to [1], wherein the chemical composition contains V: 0.01 to 0.20%.

A seamless steel pipe of [3] is the seamless steel pipe according to [1] or [2], wherein the chemical composition contains:

one or more types of element selected from the group consisting of

Co: 0.10 to 0.30%, and

W: 0.02 to 2.00%.

A method for producing a seamless steel pipe of [4] is a method for producing a seamless steel pipe including:

a heating step for heating a starting material having a chemical composition consisting of, in mass/%, C: 0.050% or less, Si: 0.50% or less, Mn: 0.01 to 0.20%, P: 0.025% or less, S: 0.0150% or less, Cu: 0.09 to 3.00%, Cr: 15.00 to 18.00%, Ni: 4.00 to 9.00%, Mo: 1.50 to 4.00%, Al: 0.040% or less, N: 0.0150% or less, Ca: 0.0010 to 0.0040%, Ti: 0.020% or less, Nb: 0.020% or less, V: 0 to 0.20%, Co: 0 to 0.30%, W: 0 to 2.00%, and the balance: Fe and impurities, and satisfying Formulae (1) and (2) at a heating temperature T of 1200 to 1260° C. for t hours;

a piercing-rolling step for piercing-rolling the starting material which has been heated in the heating step under a condition satisfying Formula (A) to produce a hollow shell;

a elongating-rolling step for elongating and rolling the hollow shell;

a quenching step for quenching the hollow shell after the elongating-rolling step at a quenching temperature of 850 to 1150° C.; and a tempering step for tempering the hollow shell after the quenching step at a tempering temperature of 400 to 700° C.:

$$156A1+18Ti+12Nb+11Mn+5V+328.125N+243.75C+12.5S\leq 12.5 \quad (1)$$

$$Ca/S\leq 4.0 \quad (2)$$

$$0.057X-Y<1720 \quad (A)$$

where, X in Formula (A) is defined by the following Formula (B), $$X=(T+273)\times\{20+\log(t)\} \quad (B)$$

where, T is a heating temperature (° C.) of the starting material, and t is a holding time (hour) at the heating temperature T, an area reduction ratio Y (%) in Formula (A) is defined by Formula (C):

$$Y=\{1-(\text{cross sectional area perpendicular to pipe axis direction of hollow shell after piercing-rolling}/\text{cross sectional area perpendicular to pipe axis direction of starting material before piercing-rolling})\}\times 100 \quad (C)$$

A method for producing a seamless steel pipe of [5] is the method for producing a seamless steel pipe according to [4], wherein the chemical composition contains V: 0.01 to 0.20%.

A method for producing a seamless steel pipe of [6] is the method for producing a seamless steel pipe according to [4] or [5], wherein the chemical composition contains:

one or more types of element selected from the group consisting of

Co: 0.10 to 0.30%, and

W: 0.02 to 2.00%.

The application of the seamless steel pipe according to the present embodiment is not particularly limited. The seamless steel pipe of the present embodiment is widely applicable to uses for which high strength and low-temperature toughness are required. The seamless steel pipe according to the present embodiment can be used as, for example, a steel pipe for geothermal power generation and a steel pipe for chemical plants. The seamless steel pipe according to the present embodiment is particularly suitable for use as an oil-well steel pipe. Examples of the seamless steel pipe for oil well applications include casing pipes, tubing pipes, drill pipes.

Hereinafter, the seamless steel pipe according to the present embodiment will be described in detail. Symbol "%" regarding an element means mass % unless otherwise specified.

[Chemical Composition]

The chemical composition of the seamless steel pipe according to the present embodiment contains the following elements.

C: 0.050% or less

Carbon (C) is unavoidably contained. That is, the C content is more than 0%. C increases the strength of the steel material. However, if the C content is more than 0.050%, the hardness after tempering becomes too high, and the low-temperature toughness decreases, even if the contents of other elements are within the range of the present embodiment. When the C content becomes more than 0.050%, retained austenite further increases. In this case, the yield strength tends to decrease even if the contents of the other elements are within the range of the present embodiment. Therefore, the C content is 0.050% or less. The lower limit of the C content is not particularly limited. However, excessive reduction of the C content will significantly increase refining costs in the steelmaking process. Therefore, considering industrial manufacturing, a lower limit of the C content is preferably 0.001%, more preferably 0.002%, further preferably 0.003%, and further preferably 0.007%. An upper limit of the C content is preferably 0.040%, and more preferably 0.030%.

Si: 0.50% or less

Silicon (Si) is unavoidably contained. That is, the Si content is more than 0%. Si deoxidizes steel. However, if the Si content becomes more than 0.50%, the low-temperature toughness and hot workability of the steel material deteriorate even if the contents of other elements are within the range of the present embodiment. Therefore, the Si content is 0.50% or less. A preferable lower limit of the Si content is not particularly limited. However, excessive reduction of the Si content will significantly increase refining costs in the steelmaking process. Therefore, considering industrial manufacturing, a lower limit of the Si content is preferably 0.01%, more preferably 0.02%, and further preferably 0.10%. An upper limit of the Si content is preferably 0.45%, and more preferably 0.40%.

Mn: 0.01 to 0.20%

Manganese (Mn) deoxidizes steel and desulfurizes steel. Mn further enhances the hot workability of the steel material. If the Mn content is less than 0.01%, these effects cannot be sufficiently obtained even if the contents of other elements are within the range of the present embodiment. On the other hand, when the Mn content becomes more than 0.20%, Mn segregates at grain boundaries together with impurities such as P and S even if the contents of other elements are within the range of the present embodiment. In this case, corrosion resistance in a high-temperature environment will deteriorate. Therefore, the Mn content is 0.01 to 0.20%. A lower limit of the Mn content is preferably 0.02%, more preferably 0.03%, and further preferably 0.05%. An upper limit of the Mn content is preferably 0.18%, more preferably 0.15%, and further preferably 0.13%.

P: 0.025% or less

Phosphorus (P) is an impurity which is unavoidably contained. That is, the P content is more than 0%. P segregates at grain boundaries and reduces low-temperature toughness of the steel material. Therefore, the P content is 0.025% or less. An upper limit of the P content is preferably 0.020%, and more preferably 0.015%. The P content is preferably as low as possible. However, excessive reduction of the P content significantly increases refining costs in the steelmaking process. Therefore, considering industrial manufacturing, a lower limit of the P content is preferably 0.001%, and more preferably 0.002%.

S: 0.0150% or less

Sulfur (S) is an impurity which is unavoidably contained. That is, the S content is more than 0%. S segregates at grain boundaries and deteriorates low-temperature toughness and hot workability of the steel material. Therefore, the S content is 0.0150% or less. An upper limit of the S content is preferably 0.0050%, more preferably 0.0030%, and further preferably 0.0020%. The S content is preferably as low as possible. However, excessive reduction of the S content will significantly increase the refining costs in the steelmaking process. Therefore, considering industrial manufacturing, a lower limit of the S content is preferably 0.0001%, more preferably 0.0002%, and further preferably 0.0003%.

Cu: 0.09 to 3.00%

Copper (Cu) increases the strength of steel material by precipitation strengthening. Cu further enhances corrosion resistance of steel material in a high-temperature environment. If the Cu content is less than 0.09%, these effects cannot be sufficiently obtained even if the contents of other elements are within the range of the present embodiment. On the other hand, if the Cu content is more than 3.00%, the hot workability of steel material will deteriorate even if the contents of other elements are within the range of the present embodiment. Therefore, the Cu content is 0.09 to 3.00%. A lower limit of the Cu content is preferably 0.10%, more preferably 0.20%, further preferably 0.80%, and further preferably 1.20%. An upper limit of the Cu content is preferably 2.90%, more preferably 2.80%, and further preferably 2.70%.

Cr: 15.00 to 18.00%

Chromium (Cr) enhances the corrosion resistance of steel materials in a high-temperature environment. Specifically, Cr reduces the corrosion rate of steel material in a high temperature environment, and enhances the carbon dioxide corrosion resistance of steel material. If the Cr content is less than 15.00%, even if the contents of other elements are within the range of the present embodiment, these effects cannot be sufficiently obtained. On the other hand, if the Cr content is more than 18.00%, the ferrite content in steel material increases and the strength of the steel material decreases even if the contents of other elements are within the range of the present embodiment. Therefore, the Cr content is 15.00 to 18.00%. A lower limit of the Cr content is preferably 15.50%, more preferably 16.00%, and further preferably 16.50%. An upper limit of the Cr content is preferably 17.80%, more preferably 17.50%, and further preferably 17.20%.

Ni: 4.00 to 9.00%

Nickel (Ni) enhances the strength of steel material. Ni further enhances corrosion resistance in a high-temperature environment. If the Ni content is less than 4.00%, even if the contents of other elements are within the range of the present embodiment, these effects cannot be sufficiently obtained. On the other hand, if the Ni content is more than 9.00%, retained austenite is likely to be excessively produced even if the content of other elements are within the range of the present embodiment. Therefore, the Ni content is 4.00 to 9.00%. A lower limit of the Ni content is preferably 4.20%, more preferably 4.40%, and further preferably 4.80%. An upper limit of the Ni content is preferably 8.70%, more preferably 8.00%, further preferably 7.00%, and further preferably 6.00%.

Mo: 1.50 to 4.00%

Molybdenum (Mo) enthances the hardenability of steel material. Mo further produces fine carbides and enhances the temper softening resistance of steel material. As a result, Mo enhances the corrosion resistance of steel material by high temperature tempering. If the Mo content is less than 1.50%, these effects cannot be sufficiently obtained even if the contents of other elements are within the range of the present embodiment. On the other hand, if the Mo content is more than 4.00%, these effects will be saturated even if the contents of other elements are within the range of the present embodiment. Therefore, the Mo content is 1.50 to 4.00%. A lower limit of the Mo content is preferably 1.60%, more preferably 1.70%, and further preferably 1.80%. An upper limit of the Mo content is preferably 3.80%, more preferably 3.50%, and further preferably 3.20%.

Al: 0.040% or less

Aluminum (Al) is unavoidably contained. That is, the Al content is more than 0%. Al deoxidizes steel. However, if the Al content is more than 0.040%, AlN is excessively generated even if the contents of other elements are within the range of the present embodiment. Since AlN is a pinning particle, it suppresses the formation of a layered structure in the L-direction cross section 1L and/or the C-direction cross section 1C. Further, coarse oxide-based inclusions are produced. The coarse oxide-based inclusions deteriorate the toughness of steel material. Therefore, the Al content is 0.040% or less. A lower limit of the Al content is preferably 0.001%, more preferably 0.005%, and further preferably 0.010%. An upper limit of the Al content is preferably 0.035%, and more preferably 0.032%. Note that the Al content referred in the present description means the content of "acid-soluble Al", that is, sol. Al.

N: 0.0150% or less

Nitrogen (N) is unavoidably contained. That is, N is more than 0%. N dissolves in steel material to increase the strength thereof. However, if the N content is more than 0.0150%, AlN is excessively generated even if the contents of other elements are within the range of the present embodiment. Since AlN is a pinning particle, it suppresses the formation of a layered structure in the L-direction cross section 1L and/or the C-direction cross section 1C. Furthermore, coarse nitrides are generated, and the corrosion resistance of steel material deteriorates. Therefore, the N content is 0.0150% or less. Excessive reduction of the N content significantly increases the refining costs in the steelmaking process. Therefore, a lower limit of the N content is preferably 0.0001%. A lower limit of the N content for more effectively achieving the above described effect is preferably 0.0020%, more preferably 0.0040%, and further preferably 0.0050%. An upper limit of the N content is preferably 0.0140%, and more preferably 0.0130%.

Ca: 0.0010 to 0.0040%

Calcium (Ca) combines with S in the steel material to form a sulfide and reduces dissolved S. This enhances the hot workability of steel material. If the Ca content is less than 0.0010%, this effect cannot be sufficiently obtained even if the contents of other elements are within the range of the present embodiment. On the other hand, if the Ca content is more than 0.0040%, coarse oxides are generated to deteriorate the corrosion resistance of steel material even if the contents of other elements are within the range of the present embodiment. Therefore, the Ca content is 0.0010 to 0.0040%. A lower limit of the Ca content is preferably 0.0012%, more preferably 0.0014%, and further preferably 0.0016%. An upper limit of the Ca content is preferably 0.0036%, and more preferably 0.0034%.

Ti: 0.020% or less

In the seamless steel pipe of the present embodiment, titanium (Ti) is unavoidably contained. That is, the Ti content is more than 0%. Ti combines with nitrogen (N) and/or carbon (C) to form a nitride, a carbide, or a carbonitride (that is, carbonitrides, etc). Usually, Ti carbonitride or the like refines crystal grains by a pinning effect and enhances the toughness of steel material. However, in the present embodiment, at the time of piercing-rolling, Ti carbonitride or the like hinders the elongation of ferrite in the L direction and/or the C direction by a pinning effect. As a result, the desired layered structure cannot be obtained. If the Ti content is more than 0.020%, even if the contents of other elements are within the range of the present embodiment, a layered structure that satisfies both Formulae (3) and (4) will not be obtained due to the pinning effect of Ti carbonitride or the like. As a result, low-temperature toughness of the seamless steel pipe deteriorates. Therefore, the Ti content is 0.020% or less. An upper limit of the Ti content is preferably 0.018%, more preferably 0.015%, further preferably 0.010%, and further preferably 0.005%. The Ti content is preferably as low as possible. However, excessive reduction of the Ti content may increase the production cost. Therefore, a preferable lower limit of the Ti content is 0.001%.

Nb: 0.020% or less

In the seamless steel pipe of the present embodiment, niobium (Nb) is unavoidably contained. That is, the Nb content is more than 0%. Nb combines with nitrogen (N) and/or carbon (C) to form Nb carbonitride or the like. Usually, Nb carbonitride or the like refines crystal grains by a pinning effect and enhances the toughness of steel material. However, in the present embodiment, at the time of piercing-rolling, Nb carbonitride or the like hinders elongation of ferrite in the L direction and/or the C direction by a pinning effect. As a result, the desired layered structure will not be obtained. If the Nb content is more than 0.020%, even if the contents of other elements are within the range of the present embodiment, a layered structure satisfying both Formulae (3) and (4) cannot be obtained due to the pinning effect of Nb carbonitride or the like. As a result, the low-temperature toughness of the seamless steel pipe deteriorates. Therefore, the Nb content is 0.020% or less. An upper limit of the Nb content is preferably 0.018%, more preferably 0.015%, further preferably 0.010%, and further preferably 0.005%. The Nb content is preferably as low as possible. However, excessive reduction of the Nb content may increase the production costs. Therefore, a preferable lower limit of the Nb content is 0.001%.

The balance of the chemical composition of the seamless steel pipe according to the present embodiment is Fe and impurities. Here, impurities include those which are mixed from ores and scraps as the raw material, or from the production environment when industrially producing the seamless steel pipe, and which are permitted within a range not adversely affecting the seamless steel pipe of the present embodiment.

[Optional Elements]

The chemical composition of the above-described seamless steel pipe may contain V in place of part of Fe.

V: 0 to 0.20%

Vanadium (V) is an optional element and may not be contained. That is, the V content may be 0%. When contained, V forms a carbonitride or the like to enhance the strength of steel material. However, if the V content is more than 0.20%, even if the contents of other elements are within the range of the present embodiment, the V carbonitride or the like exerts a pinning effect at the time of piercing-rolling, hindering elongation of ferrite in the L direction and/or the C direction. As a result, a desired layered structure cannot be obtained. That is, if the V content exceeds 0.20%, the pinning effect of the V carbonitride or the like is exhibited, so that it is not possible to obtain a layered structure that satisfies both Formulae (3) and (4). As a result, low-temperature toughness of the seamless steel pipe deteriorates. If the V content is more than 0.20%, carbonitrides or the like become further coarse, and the toughness of steel material deteriorates. Therefore, the V content is 0 to 0.20%. A lower limit of the V content is preferably more than 0%, and more preferably 0.01%. An upper limit of the V content is preferably less than 0.20%, more preferably 0.15%, and further preferably 0.10%.

The above described chemical composition of the seamless steel pipe may further contain one or more types of element selected from the group consisting of Co and W, in place of part of Fe. All of these elements are optional elements. These elements form a corrosion film on the surface of the seamless steel pipe in a high-temperature environment, and this corrosion film suppresses the invasion of hydrogen into the seamless steel pipe. Thereby, these elements enhance the corrosion resistance of the seamless steel pipe.

Co: 0 to 0.30%

Cobalt (Co) is an optional element and may not be contained. That is, the Co content may be 0%. When contained, Co forms a corrosion film on the surface of steel material (seamless steel pipe) in a high-temperature environment. This suppresses the invasion of hydrogen into the steel material. Therefore, the corrosion resistance of the steel material is enhanced. If Co is contained even in a small amount, the above described effect can be obtained to some extent. However, if the Co content is more than 0.30%, even if the contents of other elements are within the range of the present embodiment, the hardenability of steel material deteriorates and the strength of the steel material decreases. Therefore, the Co content is 0 to 0.30%. A lower limit of the Co content is preferably more than 0%, more preferably 0.01%, further preferably 0.10%, and further preferably 0.12%, and further preferably 0.14%. An upper limit of the Co content is preferably 0.29%, more preferably 0.28%, and further preferably 0.27%.

W: 0 to 2.00%

Tungsten (W) is an optional element and may not be contained. That is, the W content may be 0%. When contained, W forms a corrosion film on the surface of steel material (seamless steel pipe) in a high-temperature environment. This suppresses the invasion of hydrogen into the steel material. Therefore, the corrosion resistance of the steel material is enhanced. If W is contained even in a small amount, the above described effect can be obtained to some extent. However, if the W content is more than 2.00%, even if the contents of other elements are within the range of the present embodiment, coarse carbides are generated in steel material, and the corrosion resistance of the steel material deteriorates. Therefore, the W content is 0 to 2.00%. A lower limit of the W content is preferably more than 0%, more preferably 0.01%, further preferably 0.02%, and further preferably 0.03%. An upper limit of the W content is preferably 1.80%, more preferably 1.50%, further preferably 1.00%, further preferably 0.50%, and further preferably 0.40%.

[Formula (1)]

The chemical composition of the seamless steel pipe of the present embodiment further satisfies Formula (1):

$$156Al+18Ti+12Nb+11Mn+5V+328.125N+243.75C+12.5S\leq 12.5 \quad (1)$$

where, each symbol of element in Formula (1) is substituted by the content (mass %) of a corresponding element.

Definition is made as follows: F1=156Al+18Ti+12Nb+1Mn+5V+328.125N+243.75C+12.5S. F1 is an index relating to the amount of generation of precipitates (pinning particles) that exhibit pinning effects when the content of each element in the chemical composition is within the above described range.

As described above. Ti carbonitride and the like. Nb carbonitride and the like. Al nitride, V carbonitride and the like, and MnS may all be generated as fine precipitates (pinning particles) that exhibit pinning effects. In a case where the content of each element in the chemical composition is within the above described range, if F1 is more than 12.5, pinning particles will be excessively generated. In this case, the pinning particles suppress elongation of ferrite grains in the L direction and/or the C direction at the time of piercing-rolling. In this case, a layered structure in the L-direction cross section may not be obtained, or a layered structure in the C-direction cross section may not be obtained. As a result, Formulae (3) and (4) cannot be satisfied at the same time.

When F1 is 12.5 or less, generation of pinning particles can be sufficiently suppressed. Therefore, at the time of piercing-rolling, ferrite grains are sufficiently elongated in the L direction and the C direction. In this case, a sufficient layered structure can be obtained in both the L-direction cross section and the C-direction cross section, thus satisfying Formulae (3) and (4) at the same time.

An upper limit of F1 is preferably 12.4, more preferably 12.3, and further preferably 12.0. Note that F1 is a value obtained by rounding the second decimal place of the obtained value (that is, a value of the first decimal place).

[Formula (2)]

The above described chemical composition of the seamless steel pipe of the present embodiment further satisfies Formula (2).

$$Ca/S\leq 4.0 \quad (2)$$

The seamless steel pipe of the present embodiment is preferably excellent in hot workability in order to obtain a layered structure satisfying both Formulae (3) and (4). If it is excellent in hot workability, surface flaws are less likely to occur in the production process. A surface flaw acts as a starting point of destruction. Therefore, excellent hot workability can suppress deterioration of low-temperature toughness.

If dissolved S segregates at grain boundaries, hot workability deteriorates. If S is immobilized by Ca, the dissolved S in steel will be decreased. As a result, the hot workability of steel material can be improved.

Definition is made as: F2=Ca/S. If F2 is less than 4.0, the Ca content is insufficient with respect to the S content in the steel material. Therefore, sufficient hot workability cannot be obtained in the production process of the seamless steel pipe having a layered structure that satisfies both Formulae (3) and (4) of the present embodiment. If F2 is 4.0 or more, the Ca content with respect to the S content in the steel material is sufficient. Therefore, Ca sufficiently immobilizes S to obtain excellent hot workability.

A lower limit of F2 is preferably 4.1, more preferably 4.2, and further preferably 4.5. Note that F2 is a value obtained by rounding the second decimal place of the obtained value (that is, a value of the first decimal place).

[Microstructure]

The microstructure of the seamless steel pipe according to the present embodiment satisfies the following (I) to (III).

(I) The microstructure consists of, in total volume ratio, 80% or more of ferrite and martensite, with the balance being retained austenite.

(II) In the L-direction observation field of view, four line segments that divide the L-direction observation field of view into five equal parts in the L direction are defined as line segments $T_L$1 to $T_L$4. Four line segments that divide the L-direction observation field of view into five equal parts in the T direction are defined as line segments L1 to L4. The interface between ferrite and martensite is defined as a ferrite interface. At this time, the number of intersections $NT_L$, which is the number of intersections between the line segments $T_L$1 to $T_L$4 and the ferrite interface, is 38 or more. Then, the number of intersections NL, which is the number of intersections between the line segments L1 to L4 and the ferrite interface, and the number of intersections $NT_L$ satisfy Formula (3).

$$NT_L/NL\geq 1.80 \quad (3)$$

(III) In the C-direction observation field of view, four line segments that divide the C-direction observation field of view into five equal parts in the C direction are defined as line segments $T_C$1 to $T_C$4. Four line segments that divide the C-direction observation field of view into five equal parts in the T direction are defined as line segments C1 to C4. At this time, the number of intersections $NT_C$, which is the number of intersections between the line segments $T_C$1 to $T_C$4 and the ferrite interface, is 30 or more. Then, the number of intersections NC, which is the number of intersections between the line segments C1 to C4 and the ferrite interface, and the number of intersections $NT_C$ satisfy Formula (4).

$$NT_C/NC\geq 1.70 \quad (4)$$

Hereinafter, (I) to (III) which specify the microstructure will be described in detail.

[(I) Volume Ratio of Ferrite and Martensite]

The microstructure of the seamless steel pipe of the present embodiment contains a total volume ratio of 80% or more of ferrite and martensite, with the balance being retained austenite. Here, the martensite includes tempered martensite as well. A lower limit of the total volume ratio of ferrite and martensite is preferably 82%, more preferably 85%, further preferably 90%, further preferably 92%, further preferably 95%, further preferably 97%, and most preferably 100%.

Another phase other than ferrite and martensite in the microstructure are retained austenite. The volume ratio of retained austenite is less than 20%. An upper limit of the volume ratio of retained austenite is preferably 18%, more preferably 15%, further preferably 10%, further preferably 8%, further preferably 5%, further preferably 3%, and most preferably 0%. Note that a small amount of retained austenite enhances low-temperature toughness. Therefore, the microstructure may contain retained austenite provided that the volume ratio thereof is less than 20%. Retained austenite may not be contained.

The microstructure of the seamless steel pipe according to the present embodiment may contain precipitates and inclusions such as carbonitrides in addition to ferrite, martensite, and retained austenite. However, the total volume ratio of precipitates and inclusions is negligibly small as compared with the volume ratios of ferrite, martensite, and retained austenite. Therefore, in the present description, when the total volume ratio of ferrite and martensite is calculated by a method described later, the total volume ratio of precipitates and inclusions is neglected.

A preferable volume ratio of ferrite in the microstructure is 10 to 40%. A lower limit of the volume ratio of ferrite is preferably 12%, more preferably 14%, and further preferably 16%. An upper limit of the volume ratio of ferrite is preferably 38%, more preferably 36%, and further preferably 34%.

The total volume ratio of ferrite and martensite is determined by the following method. Specifically, a sample is taken from a center position of wall thickness of the seamless steel pipe. The size of the sample is not particularly limited as long as the following X-ray diffraction method can be performed, but an example of the size of the sample is 15 mm in the L direction, 2 mm in the T direction, and 15 mm in a direction perpendicular to the L direction and the T direction (corresponding to in the C direction). Using the obtained sample, X-ray diffraction intensity of each of the (200) plane of α phase (ferrite and martensite), the (211) plane of α phase, the (200) plane of γ phase (retained austenite), the(220) plane of γ phase, and the (311) plane of γ phase is measured and an integrated intensity of each plane is calculated. In the measurement of the X-ray diffraction intensity, Mo (Mo Kα ray: λ=71.0730 pm) is used as the target of the X-ray diffractometer and the output power thereof is 50 kV-40 mA. After the calculation, the volume ratio Vγ (%) of the retained austenite is calculated using Formula (5) for each of the combinations (2×3=6 sets) of each plane of a phase and each plane of γ phase. Then, an average value of the volume ratios $V_\gamma$ of retained austenite of the six sets is defined as the volume ratio (%) of the retained austenite.

$$V_\gamma=100/\{1+(I\alpha\times R\gamma)/(I\gamma\times R\alpha)\} \quad (5)$$

Here, Iα is the integrated intensity of the α phase. Rα is a crystallographically calculated value of the α phase. Iγ is the integrated intensity of the γ phase. Rγ is a crystallographically calculated value of the γ phase. In the present description, it is assumed that Rα at the (200) plane of α phase is 15.9, Rα at the (211) plane of α phase is 29.2, Rγ at the (200) plane of γ phase is 35.5, Rγ at the (220) plane of γ phase is 20.8, and Rγ at the (311) plane of the γ phase is 21.8.

Using the obtained volume ratio (%) of retained austenite, the total volume ratio (%) of ferrite and martensite in the microstructure is calculated by the following Formula (6).

$$\text{Total volume ratio of ferrite and martensite}=100-\text{volume ratio of retained austenite} \quad (6)$$

Note that in the present description, the value of the first decimal place of the total volume ratio of ferrite and martensite obtained by the above method is rounded.

[(II) Layered Structure in L-Direction Observation Field of View 50]

Of the microstructure of the seamless steel pipe of the present embodiment, as shown in FIG. 3, a plane parallel to the L direction and the T direction is defined as an L-direction cross section 1L. Then, in the L-direction cross section 1L, a square cross section which is located at the center position of wall thickness of the seamless steel pipe and whose side extending in the L direction is 100 μm long and whose side extending in the T direction is 100 μm long, is defined as the L-direction observation field of view 50.

FIG. 4 is a schematic diagram showing an example of the L-direction observation field of view 50. Referring to FIG. 4, four line segments that divide the L-direction observation field of view 50 into five equal parts in the L direction are defined as line segments $T_L$1 to $T_L$4. Further, four line segments that divide the L-direction observation field of view 50 into five equal parts in the T direction are defined as line segments L1 to L4. Further, the interface between ferrite 10 and martensite 20 is defined as a ferrite interface FB.

The microstructure of the seamless steel pipe according to the present embodiment satisfies the following two items in the L-direction observation field of view 50.

(II-1) The number of intersections $NT_L$, which is the number of intersections between the line segments $T_L$1 to $T_L$4 and the ferrite interface FB, is 38 or more.

(II-2) The number of intersections NL, which is the number of intersections between the line segments L1 to L4 and the ferrite interface FB, and the number of intersections $NT_L$ satisfy Formula (3).

$$NT_L/NL\geq 1.80 \quad (3)$$

The morphology of the layered structure (the number of intersections $NT_L$ and $NT_L$/NL) in the L-direction observation field of view 50 is measured by the following method.

A sample, which is located at a center position of wall thickness of the seamless steel pipe, and which has an L-direction cross section 1L (observation surface) including the L direction and the T direction, is taken. The size of the L-direction cross section 1L is not particularly limited as long as the L-direction observation field of view 50 to be described later can be secured. The L-direction cross section 1L is, for example, L direction: 5 mm×T direction: 5 mm. At this time, the sample is taken such that the center position of the L-direction cross section 1L in the T direction substantially coincides with the center position of the seamless steel pipe in the T direction (wall thickness direction).

The L-direction cross section 1L is mirror-polished. The mirror-polished L-direction cross-section 1L is immersed in a Vilella etching solution (mixed solution of nitric acid, hydrochloric acid, and glycerin) for 10 seconds to reveal the micro-structure by etching. The center position of the etched L-direction cross section 1L is observed using an optical microscope. The area of the observation field of view is 100 μm×100 μm=10000 $\mu m^2$ (a magnification of 1000 times). This observation field of view is defined as the "L-direction observation field of view 50." In the L-direction observation field of view 50, ferrite 10 and martensite 20 can be distinguished based on contrast.

Referring to FIG. 4, the L-direction observation field of view 50 includes ferrite 10 (white regions in the figure) and martensite 20 (hatched regions in the figure). In the actual L-direction observation field of view 50 that has been etched, as described above, those skilled in the art can distinguish ferrite from martensite based on contrast.

In the L-direction observation field of view 50, line segments, which extend in the T direction and are arranged at equal intervals in the L direction to divide the L-direction observation field of view 50 into five equal parts in the L direction, are defined as the line segments $T_L$1 to $T_L$4. Then, the number of intersections (marked with "•" in FIG. 4) of the line segments $T_L$1 to $T_L$4 and the ferrite interface FB in the L-direction observation field of view 50 is defined as the number of intersections $NT_L$.

Further, line segments which extend in the L direction and are arranged at equal intervals in the T direction of the L-direction observation field of view 50 to divide the L-direction observation field of view 50 into five equal parts in the T direction (wall thickness direction) are defined as the line segments L1 to L4. Then, the number of intersections (marked with "◇" in FIG. 4) between the line segments L1 to L4 and the ferrite interface in the L-direction observation field of view 50 is defined as the number of intersections NL.

The microstructure of the seamless steel pipe according to the present embodiment has a layered structure in which the number of intersections $NT_L$ is 38 or more and the layer index $LI_L$ satisfies Formula (3) in the L-direction observation field of view 50.

$$\text{Layer index } LI_L = NT_L/NL \geq 1.80 \quad (3)$$

The L-direction observation field of view 50 is selected at 10 places from arbitrary locations by the method described above. In each L-direction observation field of view 50, the number of intersections $NT_L$ and the layer index $LI_L$ are determined by the above described method. An arithmetic average value of the number of intersections $NT_L$ determined at 10 places is defined as the number of intersections $NT_L$ in the L-direction observation field of view of the seamless steel pipe of the present embodiment. Similarly, an arithmetic average value of the layer index $LI_L$ obtained at 10 places is defined as the layer index $LI_L$ in the L-direction observation field of view of the seamless steel pipe of the present embodiment.

The layer index $LI_L$ means a degree of development of layered structure in the L-direction observation field of view. When the number of intersections $NT_L$ is 38 or more and the layer index $LI_L$ is 1.80 or more, it means that in the seamless steel pipe having the above described chemical composition that satisfies Formulae (1) and (2), a sufficiently developed layered structure has been obtained in the L-direction cross section 1L.

[(III) Layered Structure in C-Direction Observation Field of View 60]

Further, in the microstructure of the seamless steel pipe of the present embodiment, not only the layered structure is sufficiently developed in the L direction, but also the layered structure is sufficiently developed in the C direction. The seamless steel pipe of the present embodiment has a yield strength of 862 MPa or more and excellent low-temperature toughness owing to the layered structure sufficiently developed not only in the L direction but also in the C direction. Hereinafter, the layered structure in the C-direction observation field of view 60 will be described in detail.

Referring to FIG. 3, a plane parallel to the C direction and the T direction is defined as a C-direction cross section 1C. Then, among the C-direction cross-sections, a square cross section which is located at the center position of wall thickness of the seamless steel pipe and whose side extending in the C direction is 100 μm long and whose side extending in the T direction is 100 μm long is defined as a C-direction observation field of view 60. Note that in the case of a minute region of 100 μm×100 μm, the C direction can be regarded as a straight line.

FIG. 5 is a schematic diagram showing an example of the C-direction observation field of view 60. Referring to FIG. 5, four line segments that divide the C-direction observation field of view 60 into five equal parts in the C direction are defined as line segments $T_C$1 to $T_C$4. Further, four line segments that divide the C-direction observation field of view 60 into five equal parts in the T direction are defined as line segments C1 to C4. Further, the interface between ferrite and martensite is defined as the ferrite interface FB, as in the case of the L-direction observation field of view 50.

In the microstructure of the seamless steel pipe according to the present embodiment, while the L-direction observation field of view 50 satisfies (II-1) and (II-2), the C-direction observation field of view 60 further satisfies the following items (III-1) and (III-2).

(III-1) The number of intersections $NT_C$, which is the number of intersections between the line segments $T_C$1 to $T_C$4 and the ferrite interface, is 30 or more.

(III-2) The number of intersections NC, which is the number of intersections between the line segments C1 to C4 and the ferrite interface, and the number of intersections $NT_C$ satisfies Formula (4).

$$NT_C/NC \geq 1.70 \quad (4)$$

The morphology of the layered structure (the number of intersections $NT_C$ and $NT_C$/NC) in the C-direction observation field of view 60 is measured by the following method.

A sample, which is located at a center position of wall thickness of the seamless steel pipe and has a C-direction cross section including the C direction and the T direction, is taken. The size of the C-direction cross section 1C is not particularly limited as long as the C-direction observation field of view 60 to be described later can be secured. The size of the C-direction cross section 1C is, for example, C direction: 5 mm×T direction: 5 mm. At this time, the sample is taken such that the center position of the C-direction cross section in the T direction substantially coincides with the center position of the seamless steel pipe in the T direction (wall thickness direction).

The C-direction cross section 1C is mirror-polished. The mirror-polished C-direction cross section 1C is immersed in the Vilella etching solution for 10 seconds to reveal the micro-structure by etching. The center position of the etched C-direction cross section 1C is observed using an optical microscope. The area of the observation field of view is 100 μm×100 μm=10000 $\mu m^2$ (a magnification of 1000 times). This observation field of view is defined as the "C-direction observation field of view 60." Referring to FIG. 5, the C-direction observation field of view 60 includes ferrite 10 and martensite 20.

In the C-direction observation field of view 60, line segments, which extend in the T direction and are arranged at equal intervals in the C direction to divide the C-direction observation field of view 60 into five equal parts in the C direction, are defined as the line segments $T_C$1 to $T_C$4. Then, the number of intersections (marked with "•" in FIG. 5) between the line segments $T_C$1 to $T_C$4 and the ferrite interface FB in the C-direction observation field of view 60 is defined as the number of intersections $NT_C$.

Further, line segments, which extend in the C direction and are arranged at equal intervals in the T direction of the C-direction observation field of view 60 to divide the C-direction observation field of view 60 into five equal parts in the T direction (wall thickness direction), are defined as the line segments C1 to C4. Then, the number of intersections (marked with "◇" in FIG. 5) between the line segments C1 to C4 and the ferrite interface in the C-direction observation field of view 60 is defined as the number of intersections NC.

The microstructure of the seamless steel pipe according to the present embodiment has a layered structure in which, while the L-direction observation field of view 50 satisfies the above described (II-1) and (II-2), further in the C-direction observation field of view 60, the number of intersections $NT_C$ is 30 or more, and the layer index $LI_C$ satisfies Formula (4).

$$\text{Layer index } LI_C = NT_C/NC \geq 1.70 \quad (4)$$

The C-direction observation field of view 60 is selected at 10 places from arbitrary locations by the method described above. In each C-direction observation field of view 60, the number of intersections $NT_C$ and the layer index $LI_C$ are obtained by the above described method. An arithmetic average value of the number of intersections $NT_C$ obtained at 10 places is defined as the number of intersections $NT_C$ in the C-direction observation field of view 60 of the seamless steel pipe of the present embodiment. Similarly, an arithmetic average value of the layer index $LI_C$ obtained at 10 places is defined as the layer index $LI_C$ in the C-direction observation field of view 60 of the seamless steel pipe of the present embodiment.

The layer index $LI_C$ means a degree of development of layered structure in the C-direction observation field of view. When the number of intersections $NT_L$ in the L-direction observation field of view 50 is 38 or more, and the layer index $LI_L$ is 1.80 or more, and further when the number of intersections $NT_C$ in the C-direction observation field of view 60 is 30 or more, and the layer index $LI_L$ is 1.70 or more, it means that in the seamless steel pipe having the above described chemical composition that satisfies Formulae (1) and (2), a sufficiently developed layered structure has been obtained not only in the L-direction cross section 1L but also in the C-direction cross section 1C.

As described above, the seamless steel pipe of the present embodiment has a chemical composition satisfying Formulae (1) and (2), and further, in the microstructure, the number of intersections $NT_L$ in the L-direction observation field of view 50 is 38 or more, and the layer index $LI_L$ is 1.80 or more, and further, the number of intersections $NT_C$ in the C-direction observation field of view 60 is 30 or more, and the layer index $LI_C$ is 1.70 or more. Therefore, the seamless steel pipe of the present embodiment can achieve both a yield strength of 862 MPa or more and excellent low-temperature toughness at the same time.

In the L-direction observation field of view 50, a lower limit of the number of intersections $NT_L$ is preferably 39, more preferably 40, further preferably 41, further preferably 55, further preferably 58, and further preferably 60. The upper limit of the number of intersections $NT_L$ is not particularly limited, but is 150, for example.

In the L-direction observation field of view 50, a lower limit of the layer index $LI_L$ is preferably 1.82, more preferably 1.84, further preferably 1.86, further preferably 1.88, further preferably 1.90, further preferably 1.92, further preferably 2.10, further preferably 2.50, further preferably 2.64, and further preferably 3.00. The upper limit of the layer index $LI_L$ is not particularly limited, but is 10.0, for example.

In the C-direction observation field of view 60, a lower limit of the number of intersections $NT_C$ is preferably 32, more preferably 34, further preferably 36, further preferably 40, further preferably 45, further preferably 50, and further preferably 54. An upper limit of the number of intersections $NT_C$ is not particularly limited, but is 150, for example.

In the C-direction observation field of view 60, a lower limit of the layer index $LI_C$ is preferably 1.75, more preferably 1.78, further preferably 1.80, further preferably 1.82, further preferably 1.85, further preferably 1.88, further preferably 1.90, further preferably 1.95, further preferably 1.98, further preferably 2.00, and further preferably 2.25. The upper limit of the layer index $LI_C$ is not particularly limited, but is 10.0, for example.

[Wall Thickness of Seamless Steel Pipe]

The wall thickness of the seamless steel pipe according to the present embodiment is not particularly limited. When the seamless steel pipe is used for oil well applications, a preferable wall thickness is 5.0 to 60.0 mm.

[Yield Strength of Seamless Steel Pipe]

The yield strength of steel material according to the present embodiment is 862 MPa or more. The yield strength referred to in the present description means 0.2% offset proof stress (MPa) obtained by a tensile test at a room temperature (20±15° C.) in the atmosphere according to ASTM E8/E8M-16a. An upper limit of the yield strength of the seamless steel pipe of this embodiment is not particularly limited. However, in the case of the above described chemical composition, an upper limit of the yield strength of the seamless steel pipe of the present embodiment is 1000 MPa, for example. An upper limit of the yield strength of the seamless steel pipe of the present embodiment is preferably 990 MPa, and more preferably 988 MPa. More preferably, the yield strength of the seamless steel pipe according to the present embodiment is of 125 ksi grade, and specifically 862 to 965 MPa.

The yield strength of the seamless steel pipe according to the present embodiment is determined by the following method. A round bar tensile test specimen is taken from the center position of wall thickness. The diameter of a parallel portion of the round bar tensile test specimen is 4 mm, and the length of the parallel portion is 35 mm. The longitudinal direction of the parallel portion of the round bar tensile test specimen is parallel to the L direction. The center position of a cross section perpendicular to the longitudinal direction of the round bar tensile test specimen is made to substantially coincide with the center position of wall thickness. Using the round bar tensile test specimen, a tensile test is performed at a room temperature (20±15° C.) in the atmosphere by a method according to ASTM E8/E8M-16a. The 0.2% offset proof stress obtained by the test is defined as the yield strength (MPa).

[Low-Temperature Toughness of Seamless Steel Pipe]

The seamless steel pipe of the present embodiment not only has high yield strength as described above, but also has excellent low-temperature toughness. Specifically, in the seamless steel pipe of the present embodiment, absorbed energy at −10° C. obtained by performing the Charpy impact test according to ASTM A370-18 will be 150 J or more.

The low-temperature toughness of the seamless steel pipe of the present embodiment is obtained by the following method. From the center position of wall thickness of the seamless steel pipe, a V-notch test specimen according to the API 5CRA/ISO13680 TABLE A. 5 is sampled. Using the test specimen, the Charpy impact test is performed according to ASTM A370-18, and absorbed energy (J) at −10° C. is determined.

[Method for Producing a Seamless Steel Pipe]

An example of a method for producing a seamless steel pipe according to the present embodiment having the above described configuration will be described. The method for producing a seamless steel pipe described below is merely an example of the method for producing a seamless steel pipe of the present embodiment. Therefore, a seamless steel pipe having the above described configuration may be produced by a production method other than the production method described below. That is, the method for producing a seamless steel pipe of the present embodiment is not limited to the production method described below. However, the production method described below is a preferred example of the method for producing a seamless steel pipe of the present embodiment.

An example of the method for producing a seamless steel pipe of the present embodiment includes a heating step, a piercing-rolling step, a elongating-rolling step, and a heat treatment step. The elongating-rolling step is an optional step and does not have to be performed. Hereinafter, each production step will be described.

[Heating Step]

In the heating step, a starting material having the above described chemical composition is heated at 1200 to 1260° C. The starting material may be prepared by producing it, or may be prepared by purchasing it from a third party.

When producing the starting material, for example, the following method is used. A molten steel having the above described chemical composition is produced. The starting material is produced by casting using the molten steel. For example, a cast piece (a slab, a bloom, or a billet) may be produced by a continuous casting process using the molten steel. An ingot may be produced by an ingot-making process by using the molten steel.

As needed, the slab, the bloom or the ingot produced by casting may be subjected to blooming to produce a billet. The starting material is produced through the above described steps.

The prepared starting material is held at a heating temperature T of 1200 to 1260° C. for a holding time t (hour). For example, the starting material is charged into a heating furnace and the starting material is heated in the heating furnace. At this time, the heating temperature T corresponds to the furnace temperature (° C.) of the heating furnace. The holding time t (hour) at the heating temperature T is, for example, 1.0 hour to 10.0 hours.

If the heating temperature is less than 1200° C., the hot workability of the starting material is too low and, therefore, surface flaws are more likely to occur in the starting material during the piercing-rolling, and the subsequent elongating-rolling.

On the other hand, if the heating temperature T is more than 1260° C., since the amount of austenite that is produced while the temperature decreases increases, the produced austenite will divide ferrite extending in the L direction. Therefore, Formula (3) and/or Formula (4) will not be satisfied.

If the heating temperature T is 1200 to 1260° C., on the assumption that conditions of each step to be described later are satisfied, a layered structure that satisfies Formulae (3) and (4) will be obtained in the microstructure of the produced seamless steel pipe.

[Piercing-Rolling Step]

The heated starting material is subjected to piercing-rolling to produce a hollow shell. Specifically, the starting material is piercing-rolled using a piercing machine. The piercing machine includes a pair of skew rolls and a plug. The pair of skew rolls are arranged around a pass line. The plug is located between the pair of skew rolls and disposed on the pass line. Here, the pass line is a line through which the central axis of the starting material passes at the time of piercing-rolling. The skew roll may be of a barrel type or a cone type.

In the piercing-rolling step, piercing-rolling is performed so as to satisfy (A):

$$0.057X-Y<1720 \quad (A)$$

where, X in Formula (A) is a heating condition parameter. The heating condition parameter X is defined by the following Formula (B):

$$X=(T+273)\times\{20+\log(t)\} \quad (B)$$

where, T in Formula (B) is a heating temperature (° C.), and t is a holding time (hour) at the heating temperature T. Y in Formula (A) is an area reduction ratio in the piercing machine. That is, the area reduction ratio Y in the piercing machine does not include the area reduction ratio by the elongating-rolling after the piercing-rolling in the piercing machine. The area reduction ratio Y (%) in the piercing machine is defined by Formula (C):

$$Y=\{1-(\text{cross sectional area perpendicular to pipe axis direction of hollow shell after piercing-rolling}/\text{cross sectional area perpendicular to pipe axis direction of starting material before piercing-rolling})\}\times 100 \quad (C)$$

Definition is made as: FA=0.057X−Y. In order to further sufficiently develop the layered structure of the C-direction cross section 1C (that is, in order to satisfy the above described (III-1) and (III-2)) while sufficiently developing the layered structure of the L-direction cross section 1L (that is, while satisfying the above described (II-1) and (II-2)) in a microstructure of a seamless steel pipe having a chemical composition satisfying Formulae (1) and (2), the relationship of the heating temperature T and the holding time t in the piercing-rolling by the piercing machine with the area reduction ratio Y in the piercing machine is important. Unless appropriate rolling reduction is applied to the starting material, which has been heated under an appropriate heating condition, by a piercing machine, it is not possible to cause the rolling reduction to sufficiently penetrate into the starting material. If the rolling reduction does not sufficiently penetrate into the starting material, the layered structure will not develop sufficiently, and in particular, a layered structure extending in the C direction will not develop sufficiently. It is possible to sufficiently develop the layered structure in the C-direction cross section by adjusting the heating condition and the piercing-rolling condition in piercing-rolling by a piercing machine. On the other hand, steps after the piercing-rolling (a elongating-rolling step, sizing rolling, and a heat treatment step) do not significantly contribute to the development of the layered structure in the C-direction cross section.

The above described FA is an index of the heating condition and the piercing-rolling condition in the piercing-rolling step to sufficiently develop the layered structure not only in the L-direction cross section 1L but also in the C-direction cross section 1C. If FA is 1720 or more, the piercing-rolling condition is inappropriate for the starting material heated to 1200 to 1260° C. In this case, in particular, the layered structure in the C-direction cross section 1C of the seamless steel pipe will not sufficiently develop. Specifically, in the C-direction observation field of view 60, the number of intersections $NT_C$ may become less than 30, or $NT_C/NC$ may become less than 1.70. Further when FA is 1720 or more, the layered structure may not sufficiently develop not only in the C-direction cross section 1C of the seamless steel pipe but also in the L-direction cross section 1L. Specifically, the number of intersections $NT_L$ may become less than 38 or $NT_L/NL$ may become less than 1.80 in the L-direction observation field of view 50.

On the other hand, if FA is less than 1720, the piercing-rolling condition is appropriate. Therefore, the starting material heated under an appropriate heating condition has been piercing-rolled at an appropriate area reduction ratio in the piercing machine. Therefore, the layered structure will sufficiently develop in both the L-direction cross section 1L and the C-direction cross section 1C of the seamless steel pipe, on the assumption that conditions for each step described below are satisfied. As a result, not only the number of intersections $NT_L$ becomes 38 or more and $NT_L/NL$ becomes 1.80 or more in the L-direction observation field of view 50 of the seamless steel pipe, but also the number of intersections $NT_C$ becomes 30 or more and $NT_C/NC$ becomes 1.70 or more in the C-direction observation field of view 60.

A lower limit of FA is not particularly limited, but the lower limit of FA is preferably 1600, more preferably 1620, further preferably 1630, further preferably 1640, and further preferably 1650. An upper limit of FA is preferably 1715, more preferably 1710, further preferably 1705, and further preferably 1695.

Note that in the present embodiment, since the chemical composition of the starting material satisfies Formula (2), the hot workability thereof will be excellent. Therefore, even if the starting material is piercing-rolled under the condition that satisfies Formula (A), the occurrence of surface flaws can be sufficiently suppressed.

Note that the temperature of the hollow shell immediately after piercing-rolling is, for example, 1050° C. or more, more preferably 1060° C. or more, and further preferably 1100° C. or more. That is, the above described Formula (A) shows the heating condition and the piercing-rolling condition in the piercing-rolling step when the starting material temperature immediately after the piercing-rolling is 1050° C. or more. The hollow shell temperature immediately after piercing-rolling can be measured by the following method. A thermometer is disposed at an exit side of the piercing machine. The surface temperature of the hollow shell after piercing-rolling is measured with the thermometer at the exit side of the piercing machine. Through the temperature measurement, the surface temperature distribution in the pipe axis direction (longitudinal direction) of the hollow shell is obtained. An average of the obtained surface temperature distribution is defined as the hollow shell temperature (° C.) after piercing-rolling.

The heating condition parameter X is not particularly limited as long as it is within the range of the above described Formula (A). A lower limit of the heating condition parameter X is preferably 29500, and more preferably 29700. An upper limit of the heating condition parameter X is preferably 31500, and more preferably 31200.

A preferable area reduction ratio Y in piercing-rolling is 25 to 80%. A lower limit of the area reduction ratio Y in piercing-rolling is more preferably 30%, and further preferably 35%. An upper limit of the area reduction ratio Y in piercing-rolling is more preferably 75%.

A degree of penetration of rolling reduction into the starting material (hollow shell) by the piercing machine is much greater than the degree of penetration of rolling reduction into the hollow shell by a mandrel mill or a sizer mill in the subsequent step. Therefore, out of the layered structures of the L-direction cross section 1L and the C-direction cross section 1C of the seamless steel pipe, especially the layered structure of the C-direction cross section 1C can satisfy the above described (II-1) and (III-2) as a result of the piercing-rolling step satisfying Formula (A). When piercing-rolling is not performed under the condition that satisfies Formula (A) in the piercing-rolling step, even if rolling reduction is performed at an increased area reduction ratio in the elongating-rolling step, it is difficult to produce a seamless steel pipe having a microstructure in which the layered structure in the L-direction cross section satisfies (II-1) and (II-2), and the layered structure in the C-direction cross section satisfies (III-1) and (III-2).

[Elongating-Rolling Step]

The elongating-rolling step does not have to be performed. When performed, in the elongating-rolling step, the hollow shell which has been produced by the piercing-rolling step is subjected to elongating-rolling. Elongating-rolling is performed by using a elongating-rolling mill. The elongating-rolling mill includes a plurality of roll stands arranged in a row from the upstream to the downstream along the pass line. Each roll stand includes a plurality of rolling rolls. The elongating-rolling mill is, for example, a mandrel mill.

A mandrel bar is inserted into the hollow shell. The hollow shell into which the mandrel bar is inserted is advanced on the pass line of the elongating-rolling mill to perform elongating-rolling. After the elongating-rolling, the mandrel bar which has been inserted into the hollow shell is pulled out. The area reduction ratio in elongating-rolling is, for example, 10 to 70%. The hollow shell temperature immediately after completion of elongating-rolling is, for example, 980 to 1000° C. The hollow shell temperature immediately after completion of elongating-rolling can be measured by the following method. A thermometer is disposed at an exit side of the stand that lastly rolls down the hollow shell in the elongating-rolling mill. The surface temperature of the hollow shell after elongating-rolling is measured by the thermometer at the exit side of the stand that lastly rolls down the hollow shell. Through the temperature measurement, surface temperature distribution of the hollow shell in the pipe axis direction is obtained. An average of the obtained surface temperature distribution is defined as the hollow shell temperature (° C.) immediately after completion of elongating-rolling.

[Sizing Rolling Step]

In the production method of the present embodiment, the hollow shell after the elongating-rolling step may be subjected to a sizing rolling step as needed. That is, the sizing rolling step does not have to be performed.

In the sizing rolling step, using a sizing rolling mill, the hollow shell is further subjected to elongating-rolling to cause the hollow shell to have a desired outer diameter. The sizing rolling mill includes a plurality of roll stands arranged in a row from the upstream toward the downstream along the pass line. Each roll stand includes a plurality of rolling rolls. Examples of the sizing rolling mill include a sizer and a stretch reducer.

Note that the piercing-rolling step, the elongating-rolling step, and the sizing rolling step are defined as a "pipe making process". A cumulative area reduction ratio in the pipe making process is, for example, 30 to 90%. The cumulative area reduction ratio is defined by the following formula.

Cumulative area reduction ratio={1−(cross sectional area perpendicular to pipe axis direction of hollow shell after pipe making process/cross sectional area perpendicular to pipe axis direction of starting material before piercing-rolling)}×100

A method of cooling the hollow shell after the piercing-rolling step, after the elongating-rolling step, or after the sizing rolling step is not particularly limited. The hollow shell after the piercing-rolling step, after the elongating-rolling step, or after the sizing rolling step may be air-cooled. The hollow shell after the piercing-rolling step, after the elongating-rolling step, or after the sizing rolling step may be directly quenched after the piercing-rolling step, after the elongating-rolling step, or after the sizing rolling step without cooling it to the room temperature. In addition, the hollow shell may be reheated after the piercing-rolling step, after the elongating-rolling step, or after the sizing rolling step, and thereafter may be subjected to quenching.

[Heat Treatment Step]

The hollow shell after the elongating-rolling step or after the sizing rolling step is subjected to a heat treatment step. The heat treatment step includes a quenching step and a tempering step.

[Quenching Step]

In the quenching step, the hollow shell is subjected to well-known quenching. For the hollow shell having the chemical composition of the present embodiment, the quenching temperature is 850 to 1150° C. In this quenching temperature range, the microstructure of the hollow shell will be a duplex micro-structure of austenite and ferrite.

Quenching may be performed by direct quenching in which quenching is performed after the piercing-rolling step, immediately after the elongating-rolling step, or immediately after the sizing rolling step. Further, the hollow shell which has been once cooled after the piercing-rolling step, after the elongating-rolling step, or after the sizing rolling step may be reheated using a heat treatment furnace to perform quenching. In the case of direct quenching, the surface temperature of the hollow shell measured by a thermometer disposed at an exit side of the final stand is defined as the quenching temperature (° C.). When performing quenching using a heat treatment furnace, the furnace temperature of the heat treatment furnace is defined as the quenching temperature (° C.). The holding time at the quenching temperature is not particularly limited. When using the heat treatment furnace, the holding time at the quenching temperature is, for example, 10 to 60 minutes.

A rapid cooling method (quenching method) of the hollow shell at a quenching temperature is not particularly limited. The hollow shell may be rapidly cooled by immersing the hollow shell in a water tank, or the hollow shell may be rapidly cooled by pouring or spraying cooling water to the outer surface and/or the inner surface of the hollow shell by shower cooling or mist cooling.

Quenching may be performed multiple times. For example, after the hollow shell after the piercing-rolling step, after the elongating-rolling step, or after sizing rolling step is subjected to direct quenching, the hollow shell may be heated to a quenching temperature using the heat treatment furnace, and then may be subjected to quenching again. Further, quenching and tempering to be described below may be repeatedly performed multiple times. That is, quenching and tempering may be performed multiple times. When performing quenching and tempering multiple times, the quenching temperature in each quenching is 850 to 1150° C., and the holding time at the quenching temperature is 10 to 60 minutes. The tempering temperature in each tempering is 400 to 700° C., and the holding time at the tempering temperature is 15 to 120 minutes. The microstructure of the hollow shell after quenching mainly contains ferrite and martensite, with the balance being retained austenite.

[Tempering Step]

In the tempering step, the hollow shell after the above described quenching step is subjected to tempering. In the hollow shell having the chemical composition of the present embodiment, the tempering temperature is 400 to 700° C. The holding time at the tempering temperature is not particularly limited, but is, for example, 15 to 120 minutes.

By the heat treatment step (the quenching step and the tempering step) described above, the yield strength of the seamless steel pipe is adjusted to be 862 MPa or more. In the microstructure of the seamless steel pipe after the tempering step, a total volume ratio of ferrite and martensite (tempered martensite) will be 80% or more, and the retained austenite is 20% or less.

The seamless steel pipe according to the present embodiment can be produced by the above described production method. In the seamless steel pipe of the present embodiment, the content of each element in the chemical composition is within the above described range, and satisfies Formulae (1) and (2). Furthermore, in the microstructure, (I) the total volume ratio of ferrite and martensite is 80% or more, with the balance being retained austenite, (II) the number of intersections $NT_L$ in the L-direction observation field of view 50 is 38 or more and $NT_L/NL$ is 1.80 or more, and further (III) the number of intersections $NT_C$ in the C-direction observation field of view 60 is 30 or more and $NT_C/NC$ is 1.70 or more. Therefore, the yield strength is 862 MPa or more and excellent low-temperature toughness is obtained. That is, it is possible to achieve both high yield strength and high low-temperature toughness at the same time.

Note that the above described production method is an example of the method for producing a seamless steel pipe according to the present embodiment. Therefore, the seamless steel pipe of the present embodiment may be produced by another production method other than the above described production method provided that the seamless steel pipe has a chemical composition satisfying Formulae (1) and (2), and in its microstructure, (I) a total volume ratio of ferrite and martensite is 80% or more, with the balance being retained austenite, (II) the number of intersections $NT_L$ in the L-direction observation field of view is 38 or more and $NT_L/NL$ is 1.80 or more, and further (III) the number of intersections $NT_C$ in the C-direction observation field of view is 30 or more and $NT_C/NC$ is 1.70 or more.

Examples

Round billets having chemical compositions shown in Table 1 were produced.

[Table 1]

TABLE 1

| Steel | Chemical component value (mass %, the balance: Fe and impurities) | | | | | | | | | | | | | | | | | | F2 = |
|---|---|---|---|---|---|---|---|---|---|---|---|---|---|---|---|---|---|---|---|
| No. | C | Si | Mn | P | S | Cu | Cr | Ni | Mo | Al | N | Ca | Ti | Nb | V | Co | W | F1 | Ca/S |
| A | 0.008 | 0.30 | 0.06 | 0.012 | 0.0002 | 2.45 | 16.98 | 4.59 | 2.48 | 0.028 | 0.0080 | 0.0010 | 0.005 | 0.001 | 0.06 | 0.16 | 0.04 | 10.0 | 5.0 |
| B | 0.010 | 0.31 | 0.06 | 0.012 | 0.0003 | 2.47 | 17.02 | 4.69 | 2.47 | 0.030 | 0.0101 | 0.0012 | 0.004 | 0.001 | 0.06 | 0.15 | 0.03 | 11.5 | 4.0 |

TABLE 1-continued

| Steel | Chemical component value (mass %, the balance: Fe and impurities) | | | | | | | | | | | | | | | | | | F2 = |
|---|---|---|---|---|---|---|---|---|---|---|---|---|---|---|---|---|---|---|---|
| No. | C | Si | Mn | P | S | Cu | Cr | Ni | Mo | Al | N | Ca | Ti | Nb | V | Co | W | F1 | Ca/S |
| C | 0.009 | 0.28 | 0.10 | 0.011 | 0.0003 | 2.20 | 16.76 | 4.46 | 2.48 | 0.031 | 0.0083 | 0.0015 | 0.005 | 0.001 | 0.05 | 0.15 | 0.03 | 11.2 | 5.0 |
| D | 0.009 | 0.28 | 0.10 | 0.013 | 0.0003 | 2.10 | 16.59 | 4.61 | 2.49 | 0.033 | 0.0084 | 0.0014 | 0.006 | 0.001 | 0.05 | 0.15 | 0.15 | 11.6 | 4.7 |
| E | 0.008 | 0.30 | 0.06 | 0.012 | 0.0002 | 2.45 | 16.98 | 4.59 | 2.48 | 0.028 | 0.0080 | 0.0010 | 0.005 | 0.001 | 0.06 | 0.15 | 0.03 | 10.0 | 5.0 |
| F | 0.008 | 0.30 | 0.06 | 0.012 | 0.0002 | 2.45 | 16.98 | 4.59 | 2.48 | 0.028 | 0.0080 | 0.0010 | 0.005 | 0.001 | 0.06 | 0.15 | 0.03 | 10.0 | 5.0 |
| G | 0.007 | 0.29 | 0.06 | 0.014 | 0.0002 | 2.49 | 16.98 | 4.71 | 2.48 | 0.040 | 0.0096 | 0.0020 | 0.005 | 0.002 | 0.06 | 0.15 | 0.03 | 12.2 | 10.0 |
| H | 0.009 | 0.32 | 0.10 | 0.010 | 0.0005 | 2.47 | 16.92 | 4.78 | 2.50 | 0.037 | 0.0088 | 0.0016 | 0.005 | 0.001 | 0.05 | 0.15 | 0.03 | 12.3 | 3.2 |
| J | 0.008 | 0.32 | 0.04 | 0.018 | 0.0005 | 1.87 | 16.75 | 5.42 | 2.11 | 0.030 | 0.0057 | 0.0022 | 0.004 | 0.007 | | | | 9.1 | 4.4 |
| K | 0.006 | 0.40 | 0.10 | 0.022 | 0.0004 | 1.84 | 16.04 | 5.45 | 2.70 | 0.033 | 0.0092 | 0.0023 | 0.008 | 0.001 | 0.06 | | | 11.2 | 5.8 |
| L | 0.008 | 0.38 | 0.08 | 0.017 | 0.0007 | 1.81 | 16.23 | 5.51 | 2.36 | 0.024 | 0.0076 | 0.0032 | 0.010 | 0.013 | 0.07 | 0.18 | | 9.8 | 4.6 |
| M | 0.006 | 0.39 | 0.03 | 0.016 | 0.0006 | 2.39 | 16.89 | 4.50 | 2.01 | 0.030 | 0.0069 | 0.0034 | 0.025 | 0.009 | | | | 9.3 | 5.7 |
| N | 0.005 | 0.33 | 0.10 | 0.022 | 0.0005 | 1.39 | 16.41 | 5.44 | 2.77 | 0.031 | 0.0081 | 0.0021 | 0.004 | 0.025 | | | | 10.2 | 4.2 |
| O | 0.007 | 0.33 | 0.09 | 0.023 | 0.0005 | 2.20 | 16.58 | 4.76 | 2.20 | 0.026 | 0.0088 | 0.0015 | 0.002 | 0.019 | | | | 9.9 | 3.0 |
| P | 0.010 | 0.38 | 0.13 | 0.017 | 0.0003 | 2.46 | 16.89 | 4.70 | 2.50 | 0.036 | 0.0097 | 0.0014 | 0.001 | 0.001 | 0.05 | 0.08 | 0.01 | 13.0 | 4.7 |

A blank portion in Table 1 means that the content of the corresponding element was less than the detection limit. That is, it means that the corresponding element was not contained.

A plurality of round billets, which were the starting materials, were produced by a continuous casting process using molten steel. The round billet was heated at a heating temperature T (° C.) for a holding time t (hour) shown in Table 2. The heated round billet was subjected to piercing-rolling by use of a piercing machine to produce a hollow shell. A heating condition parameter X, an area reduction ratio Y (%) of a piercing machine, and FA (=0.057X−Y) of each test number during piercing-rolling were as shown in Table 2. Note that the temperature of the hollow shell of each test number immediately after piercing-rolling was 1050° C. or more.

[Table 2]

TABLE 2

| Test No. | Steel No. | Heating temperature T (° C.) | Holding time t (hour) | Heating condition parameter X | Area reduction ratio Y (%) of piercing machine | Cumulative area reduction ratio (%) | Outer diameter (mm) | Wall thickness (mm) | FA | F + M Total volume ratio (%) | L-direction observation field of view | | | C-direction observation field of view | | | Metal structure determination | Yield strength (MPa) | Absorbed energy (J) | Hot workability | Remarks |
|---|---|---|---|---|---|---|---|---|---|---|---|---|---|---|---|---|---|---|---|---|---|
| | | | | | | | | | | | $NT_L$ | NL | Layer index $L/_L$ = $NT_L$/NL | $NT_C$ | NC | Layer index $L/_C$ = NTc/NC | | | | | |
| 1 | A | 1200 | 2.9 | 30136 | 39 | 69 | 168.3 | 27.3 | 1679 | ≥80 | 60 | 11 | 5.45 | 57 | 12 | 4.94 | Layered | 876 | 234 | E | Inventive Example |
| 2 | B | 1230 | 3.0 | 30783 | 39 | 69 | 168.3 | 27.3 | 1716 | ≥80 | 56 | 26 | 2.15 | 54 | 28 | 1.95 | Layered | 939 | 192 | E | Inventive Example |
| 3 | B | 1200 | 2.7 | 30086 | 46 | 75 | 159.0 | 22.1 | 1669 | ≥80 | 68 | 14 | 4.86 | 65 | 15 | 4.36 | Layered | 907 | 219 | E | Inventive Example |
| 4 | A | 1200 | 2.0 | 29903 | 50 | 50 | 91.5 | 13.0 | 1654 | ≥80 | 40 | 17 | 2.30 | 38 | 19 | 1.97 | Layered | 880 | 185 | E | Inventive Example |
| 5 | A | 1230 | 2.0 | 30512 | 50 | 50 | 91.5 | 12.9 | 1689 | ≥80 | 51 | 25 | 2.04 | 49 | 27 | 1.82 | Layered | 866 | 173 | E | Inventive Example |
| 6 | A | 1200 | 2.5 | 30046 | 38 | 69 | 168.3 | 27.3 | 1674 | ≥80 | 58 | 12 | 4.83 | 52 | 13 | 3.99 | Layered | 986 | 220 | E | Inventive Example |
| 7 | A | 1230 | 2.1 | 30544 | 42 | 69 | 168.3 | 27.3 | 1699 | ≥80 | 79 | 28 | 2.82 | 76 | 31 | 2.46 | Layered | 986 | 206 | E | Inventive Example |
| 8 | A | 1240 | 2.7 | 30913 | 56 | 69 | 168.3 | 27.3 | 1706 | ≥80 | 82 | 22 | 3.77 | 80 | 23 | 3.52 | Layered | 918 | 201 | E | Inventive Example |
| 9 | A | 1250 | 2.4 | 31039 | 71 | 75 | 159.0 | 22.1 | 1699 | ≥80 | 52 | 15 | 3.47 | 48 | 16 | 3.01 | Layered | 919 | 211 | E | Inventive Example |
| 10 | C | 1240 | 3.0 | 30987 | 56 | 69 | 168.3 | 27.3 | 1710 | ≥80 | 65 | 20 | 3.25 | 59 | 22 | 2.69 | Layered | 934 | 194 | E | Inventive Example |
| 11 | D | 1240 | 3.0 | 30987 | 56 | 69 | 168.3 | 27.3 | 1710 | ≥80 | 57 | 22 | 2.59 | 54 | 24 | 2.24 | Layered | 980 | 213 | E | Inventive Example |
| 12 | J | 1230 | 3.1 | 30799 | 38 | 60 | 177.8 | 31.8 | 1717 | ≥80 | 58 | 22 | 2.64 | 54 | 24 | 2.25 | Layered | 948 | 233 | E | Inventive Example |
| 13 | J | 1200 | 3.0 | 30163 | 26 | 72 | 195.5 | 19.6 | 1693 | ≥80 | 51 | 23 | 2.22 | 53 | 27 | 1.96 | Layered | 895 | 210 | E | Inventive Example |
| 14 | K | 1230 | 2.3 | 30604 | 42 | 60 | 177.8 | 31.8 | 1703 | ≥80 | 60 | 18 | 3.33 | 55 | 20 | 2.78 | Layered | 916 | 241 | E | Inventive Example |
| 15 | L | 1230 | 2.5 | 30658 | 46 | 60 | 177.8 | 31.8 | 1702 | ≥80 | 57 | 16 | 3.56 | 50 | 17 | 2.99 | Layered | 950 | 235 | E | Inventive Example |
| 16 | B | 1240 | 3.0 | 30982 | 35 | 60 | 177.8 | 31.8 | 1731 | ≥80 | 40 | 21 | 1.90 | 32 | 22 | 1.45 | Non-layered | 910 | 112 | E | Comparative Example |
| 17 | E | 1260 | 2.5 | 31270 | 30 | 72 | 195.5 | 19.6 | 1753 | ≥80 | 23 | 12 | 1.92 | 20 | 12 | 1.62 | Non-layered | 943 | 73 | E | Comparative Example |
| 18 | E | 1240 | 2.1 | 30748 | 26 | 72 | 195.5 | 19.6 | 1726 | ≥80 | 41 | 22 | 1.86 | 34 | 22 | 1.50 | Non-layered | 900 | 62 | E | Comparative Example |
| 19 | E | 1250 | 2.4 | 31039 | 28 | 72 | 195.5 | 19.6 | 1741 | ≥80 | 59 | 32 | 1.84 | 49 | 32 | 1.53 | Non-layered | 907 | 78 | E | Comparative Example |
| 20 | J | 1260 | 4.1 | 31599 | 63 | 84 | 177.8 | 11.5 | 1738 | ≥80 | 58 | 30 | 1.93 | 43 | 26 | 1.65 | Non-layered | 910 | 126 | E | Comparative Example |
| 21 | G | 1260 | 5.5 | 31791 | 46 | 75 | 159.0 | 22.1 | 1766 | ≥80 | 59 | 36 | 1.64 | 47 | 36 | 1.30 | Non-layered | 969 | 43 | E | Comparative Example |

TABLE 2-continued

| Test No. | Steel No. | Heating temperature T (° C.) | Holding time t (hour) | Heating condition parameter X | Area reduction ratio Y (%) of piercing machine | Cumulative area reduction ratio (%) | Outer diameter (mm) | Wall thickness (mm) | FA | F + M Total volume ratio (%) | L-direction observation field of view | | | C-direction observation field of view | | | Metal structure determination | Yield strength (MPa) | Absorbed energy (J) | Hot workability | Remarks |
|---|---|---|---|---|---|---|---|---|---|---|---|---|---|---|---|---|---|---|---|---|---|
| | | | | | | | | | | | $NT_L$ | NL | Layer index $L_L$ = $NT_L$/NL | $NT_C$ | NC | Layer index $L_C$ = NTc/NC | | | | | |
| 22 | G | 1260 | 6.0 | 31853 | 34 | 62 | 177.8 | 31.8 | 1782 | ≥80 | 52 | 42 | 1.24 | 44 | 42 | 1.04 | Non-layered | 869 | 83 | E | Comparative Example |
| 23 | A | 1250 | 2.0 | 30918 | 39 | 39 | 89.9 | 17.0 | 1723 | ≥80 | 86 | 106 | 0.81 | 77 | 109 | 0.70 | Non-layered | 870 | 144 | E | Comparative Example |
| 24 | J | 1260 | 4.3 | 31631 | 42 | 69 | 168.3 | 27.3 | 1761 | ≥80 | 67 | 56 | 1.20 | 54 | 57 | 0.96 | Non-layered | 894 | 121 | E | Comparative Example |
| 25 | J | 1260 | 5.0 | 31732 | 28 | 72 | 195.5 | 19.6 | 1780 | ≥80 | 57 | 34 | 1.68 | 34 | 22 | 1.50 | Non-layered | 913 | 88 | E | Comparative Example |
| 26 | F | 1285 | 2.8 | 31857 | 63 | 84 | 177.8 | 11.5 | 1753 | ≥80 | 126 | 102 | 1.24 | 103 | 103 | 1.00 | Non-layered | 863 | 87 | E | Comparative Example |
| 27 | A | 1270 | 2.0 | 31324 | 52 | 52 | 89.7 | 9.4 | 1733 | ≥80 | 87 | 66 | 1.32 | 75 | 67 | 1.12 | Non-layered | 888 | 137 | E | Comparative Example |
| 28 | A | 1270 | 2.0 | 31324 | 63 | 63 | 89.7 | 9.4 | 1722 | ≥80 | 74 | 88 | 0.84 | 60 | 90 | 0.67 | Non-layered | 893 | 141 | E | Comparative Example |
| 29 | J | 1285 | 3.2 | 31947 | 52 | 52 | 89.7 | 9.4 | 1769 | ≥80 | 86 | 91 | 0.95 | 74 | 93 | 0.80 | Non-layered | 881 | 129 | E | Comparative Example |
| 30 | M | 1240 | 2.4 | 30835 | 38 | 69 | 168.3 | 27.3 | 1719 | ≥80 | 63 | 39 | 1.62 | 51 | 39 | 1.30 | Non-layered | 893 | 136 | E | Comparative Example |
| 31 | N | 1240 | 2.5 | 30862 | 42 | 69 | 168.3 | 27.3 | 1718 | ≥80 | 58 | 34 | 1.71 | 49 | 35 | 1.39 | Non-layered | 868 | 113 | E | Comparative Example |
| 32 | H | 1230 | 3.4 | 30859 | 56 | 69 | 168.3 | 27.3 | 1703 | ≥80 | 61 | 22 | 2.76 | 57 | 23 | 2.45 | Layered | 905 | 189 | NA | Comparative Example |
| 33 | P | 1230 | 3.7 | 30914 | 71 | 75 | 159.0 | 22.1 | 1691 | ≥80 | 54 | 16 | 3.38 | 53 | 17 | 3.18 | Layered | 922 | 173 | NA | Comparative Example |
| 34 | P | 1230 | 2.6 | 30684 | 46 | 60 | 177.8 | 31.8 | 1703 | ≥80 | 51 | 34 | 1.50 | 43 | 34 | 1.27 | Non-layered | 922 | 89 | E | Comparative Example |

The hollow shell after piercing-rolling was subjected to elongating-rolling. A mandrel mill was used for the elongating-rolling. The cumulative area reduction ratio after elongating-rolling (that is, the cumulative area reduction ratio of the piercing-rolling step and the elongating-rolling step in all) (%) was as shown in the "Cumulative area reduction ratio" column in Table 2. Note that in Test Nos. 4, 5, 23, and 27 to 29, elongating and rolling was not performed after piercing-rolling was performed.

For test numbers 4, 5, 23, and 27 to 29, the hollow shell after piercing-rolling was allowed to be cooled to a room temperature (20±15° C.). For other test numbers, the hollow shell after elongating-rolling was allowed to be cooled to a room temperature. Thereafter, the hollow shell was subjected to quenching. Specifically, the hollow shell was charged in a heat treatment furnace, held at a quenching temperature of 950° C. for 15 minutes, and thereafter immersed in a water tank to perform water cooling (water quenching). The hollow shell after quenching was subjected to tempering. Specifically, the hollow shell was charged in the heat treatment furnace and held at a tempering temperature of 550° C. for 30 minutes. Through the above described production process, a seamless steel pipe, which was steel material of each test number, was produced. The outer diameter (mm) and the wall thickness (mm) of the produced seamless steel pipe of each test number are shown in Table 2.

[Evaluation Test]

[Microstructure Observation Test]

A sample was taken from the center position of wall thickness of the seamless steel pipe of each test number. The size of the sample was 15 mm in the L direction of the seamless steel pipe, 2 mm in the T direction thereof, and 15 mm in a direction perpendicular to the L direction and the T direction (corresponding to in the C direction) thereof. Using the obtained sample, the X-ray diffraction intensity of each of the (200) plane of α phase (ferrite and martensite), the (211) plane of α phase, the (200) plane of 7 phase (retained austenite), the (220) plane of γ phase, and the (311) plane of γ phase was measured, and the integrated intensity of each plane was calculated. As the X-ray diffractometer, a trade name: MXP3 manufactured by Bruker Com. was used with the target being Mo (Mo Kα ray: λ=71.0730 pm) and the output power being 50 kV-40 mA. After the calculation, the volume ratio Vγ (%) of the retained austenite was calculated using Formula (5) for each of combinations (2×3=6 sets) of each plane of α phase and each plane of γ phase. Then, an average value of the volume ratios Vγ of the retained austenite of the six sets was defined as the volume ratio (%) of retained austenite.

$$V\gamma=100/\{1+(I\alpha\times R\gamma)/(I\gamma\times R\alpha)\} \quad (5)$$

Here, it was assumed that Rα on the (200) plane of α phase was 15.9, Rα on the (211) plane of α phase was 29.2, Rγ on the (200) plane of γ phase was 35.5, Rγ on the (220) plane of γ phase was 20.8, and Rγ on the (311) plane of γ phase was 21.8.

Using the obtained volume ratio (%) of retained austenite, the total volume ratio (%) of ferrite and martensite in the microstructure was calculated by the following Formula (6).

$$\text{Total volume ratio of ferrite and martensite}=100-\text{volume ratio of retained austenite} \quad (6)$$

"F+M total volume ratio (%)" in Table 2 shows the total volume ratio (%) of ferrite and martensite. As a result of the measurement, in the seamless steel pipes of all test numbers, the total volume ratio of ferrite and martensite was 80% or more, and the balance was retained austenite.

[Layered Structure Confirmation Test]

A degree of development of layered structure in the L-direction observation field of view and a degree of development of layered structure in the C-direction observation field of view were measured by the following method.

[Layered Structure in L-Direction Observation Field of View]

A sample was taken, which was located at a center position in the T direction (wall thickness direction) of the seamless steel pipe of each test number and had a cross section (L-direction cross section) including the L direction and the T direction. The L-direction cross section was a plane including the L direction and the T direction. The size of the L-direction cross section was L direction: 5 mm×T direction: 5 mm. A sample was taken such that the center position of the L-direction cross section in the T direction substantially coincides with the center position of the seamless steel pipe in the T direction (wall thickness direction). After the L-direction cross section was mirror-polished, the L-direction cross section was immersed in a Vilella etching solution for 10 seconds to reveal the micro-structure by etching. A layered structure confirmation test was performed on the etched L-direction cross section using an optical microscope with a magnification of 1000 times.

In the layered structure confirmation test, in the etched L-direction cross section, an arbitrary L-direction observation field of view, which was 100 μm in the L direction and 100 μm in the T direction, was selected at 10 places. In each L-direction observation field of view, martensite and ferrite were distinguishable based on contrast. In each L-direction observation field of view, martensite and ferrite were identified based on contrast.

Further, in each L-direction observation field of view, line segments $T_L$ 1 to $T_L$4 extending in the T direction were arranged at equal intervals in the L direction to divide the L-direction observation field of view into 5 equal parts in the L direction. Further, line segments L1 to L4 extending in the L direction were arranged at equal intervals in the T direction to divide the L-direction observation field of view into 5 equal parts in the T direction. The number of intersections between the line segments $T_L$1 to $T_L$4 and the ferrite interface in the L-direction observation field of view was counted and set as the number of intersections $NT_L$. The number of intersections between the line segments L1 to L4 and the ferrite interface in the L-direction observation field of view was counted and set as the number of intersections NL. The layer index $LI_L=NT_L/NL$ was obtained using the obtained number of intersections $NT_L$ and the number of intersections NL. An average value of 10 of the number of intersections $NT_L$ obtained in each of the L-direction observation fields of view at 10 places was defined as the number of intersections $NT_L$ in the seamless steel pipe of that test number. The average value of 10 of the layer indices $LI_L$ obtained on each of the L-direction observation fields of view at 10 places was defined as the layer index $LI_L$ in the seamless steel pipe of that test number. The obtained number of intersections $NT_L$, the obtained number of intersections NL and the obtained layer index $LI_L$ are shown in Table 2.

[Layered Structure in C-Direction Observation Field of View]

A sample was taken, which was located at a center position in the T direction (wall thickness direction) of a seamless steel pipe of each test number, and had a cross section (C-direction cross section) including the C direction and the T direction. The C-direction cross section was a plane including the C direction and the T direction. The size of the C-direction cross section was C direction: 5 mm×T direction: 5 mm. A sample was taken such that the center position of the C-direction cross section in the T direction substantially coincides with the center position of the seamless steel pipe in the T direction (wall thickness direction). After the C-direction cross section was mirror-polished, the C-direction cross section was immersed in a Vilella etching solution for 10 seconds to reveal the micro-structure by etching. A layered structure confirmation test was performed on the etched C-direction cross section using an optical microscope with a magnification of 1000 times.

In the layered structure confirmation test, in the etched C-direction cross section, an arbitrary C-direction observation field of view of 100 μm in the C direction and 100 μm in the T direction was selected at 10 places. In each C-direction observation field of view, martensite and ferrite were distinguishable based on contrast. In each C-direction observation field of view, martensite and ferrite were identified based on contrast.

Further, in each C-direction observation field of view, line segments $T_C$1 to $T_C$4 extending in the T direction were arranged at equal intervals in the C direction to divide the C-direction observation field of view into 5 equal parts in the C direction.

Further, line segments C1 to C4 extending in the C direction were arranged at equal intervals in the T direction to divide the C-direction observation field of view into 5 equal parts in the T direction. The number of intersections between the line segments $T_C$1 to $T_C$4 and the ferrite interface in the C-direction observation field of view was counted and set as the number of intersections $NT_C$. The number of intersections between the line segments C1 to C4 and the ferrite interface in the C-direction observation field of view was counted and set as the number of intersections NC. The layer index $LI_C$=$NT_C$/NC was obtained using the obtained number of intersections $NT_C$ and the number of intersections NC. An average value of 10 of the number of intersections $NT_C$ obtained in each of the C-direction observation fields of view at 10 places was defined as the number of intersections $NT_C$ in the seamless steel pipe of that test number. Further, an average value of 10 of the layer index $LI_C$ obtained in each of the C-direction observation fields of view at 10 places was defined as the layer index $LI_C$ in the seamless steel pipe of that test number. The obtained number of intersections $NT_C$, the obtained number of intersections NC, and the obtained layer index $LI_C$ are shown in Table 2.

When (II) and (III) were satisfied in the microstructure, that is, when (II) the number of intersections $NT_L$ in the L-direction observation field of view was 38 or more and $NT_L$/NL was 1.80 or more, and further (III) the number of intersections $NT_C$ in the C-direction observation field of view was 30 or more and $NT_C$/NC was 1.70 or more, it was judged that both the L-direction cross section and the C-direction cross section had a layered structure in the microstructure (described as "layered" in the "Microstructure determination" column of Table 2). On the other hand, when any one of (II) and (III) was not satisfied in the microstructure, it was judged that the microstructure was not a layered structure (described as "non-layered" in the "Microstructure determination" column of Table 2).

[Tensile Test]

A round bar tensile test specimen was taken from the center position of wall thickness of the seamless steel pipe of each test number. The diameter of the parallel portion of the round bar tensile test specimen was 4 mm, and the length of the parallel portion was 35 mm. The longitudinal direction of the round bar tensile test specimen was parallel to the pipe axis direction (L direction) of the seamless steel pipe. Using each round bar tensile test specimen, a tensile test was carried out at a room temperature (20±15° C.) in the atmosphere to determine the yield strength (MPa). Specifically, the 0.2% offset proof stress obtained in the tensile test was defined as the yield strength. The obtained yield strength (MPa) is shown in the "Yield strength" column of Table 2.

[Low-Temperature Toughness Evaluation Test]

A V-notch test specimen according to API 5CRA/ISO 13680 TABLE A. 5 was taken from a center position of wall thickness of the seamless steel pipe of each test number. Using the test specimen, a Charpy impact test was carried out in accordance with ASTM A370-18, and absorbed energy (J) at −10° C. was determined. The obtained results are shown in the "Absorbed energy" column of Table 2.

[Hot Workability Test]

A hot workability test (Gleeble test) was performed using a round billet of each steel number. Specifically, a plurality of test specimens each having a diameter of 10 mm and a length of 130 mm were cut out from the billet of each steel number. The central axis of the test specimen coincided with the central axis of the round billet. Using a high-frequency induction heating furnace, the test specimen was heated to 1250° C. in 3 minutes and then held at 1250° C. for 3 minutes. Thereafter, each of the plurality of test specimens of a steel number was cooled to 1250° C., 1200° C., 1100° C., and 1000° C. at a rate of 100° C./sec, and thereafter a tensile test was performed at a strain rate of 10 $sec^{-1}$ to tear it off. At each temperature (1250° C., 1200° C., 1100° C., 1000° C.), the area reduction ratio of the torn test specimen was determined. If the obtained area reduction ratio was 70.0% or more at any temperature, it was judged that the steel material of that steel number had excellent hot workability (denoted as "E" (Excellent) in the "Hot workability" column of Table 2). On the other hand, when the area reduction ratio was less than 70.0% in any temperature range, it was judged that the hot workability was poor (denoted as "NA" (Not Accepted) in the "Hot workability" column of Table 2).

[Test Results]

Table 2 shows test results.

Referring to Tables 1 and 2, the chemical compositions of the seamless steel pipes of Test Nos. 1 to 15 were appropriate and satisfied Formulae (1) and (2). Furthermore, the production conditions were also appropriate. Therefore, in the microstructure of the seamless steel pipe of each test number, the total volume ratio of ferrite and martensite was 80% or more, with the balance being retained austenite. Further, the number of intersections $NT_L$ in the L-direction observation field of view was 38 or more and $NT_L$/NL was 1.80 or more, and further, the number of intersections $NT_C$ in the C-direction observation field of view was 30 or more and $NT_C$/NC was 1.70 or more. That is, in the microstructures in the seamless steel pipes of Test Nos. 1 to 15, a layered structure had sufficiently developed both in the L-direction cross section and the C-direction cross section. As a result, the yield strength was 862 MPa or more, and sufficient hot workability was obtained. Further, absorbed energy at −10° C. was 150 J or more, thus achieving excellent low-temperature toughness.

On the other hand, in Test Nos. 16 to 25, although the heating temperature T was appropriate, FA did not satisfy Formula (A) in the piercing-rolling. For that reason, in Test Nos. 16 to 25, at least, $NT_C$/NC in the C-direction observation field of view was less than 1.70. That is, in the microstructures of the seamless steel pipes of Test Nos. 16 to 25, the layered structure had not sufficiently developed, at least, in the C-direction cross section. As a result, the absorbed energy at −10° C. was less than 150 J, thus exhibiting poor low-temperature toughness.

Note that in Test Nos. 16 to 20, in the microstructures, although $NT_L$/NL in the L-direction observation field of view was 1.80 or more, $NT_C$/NC in the C-direction observation field of view was less than 1.70. For that reason, the absorbed energy at −10° C. was less than 150 J, thus exhibiting poor low-temperature toughness.

In Test Nos. 26 to 29, the heating temperature was too high. For that reason, in the microstructure, $NT_L$/NL in the L-direction observation field of view was less than 1.80, and $NT_C$/NC in the C-direction field of view was less than 1.70. As a result, the absorbed energy at −10° C. was less than 150 J, thus exhibiting poor low-temperature toughness.

In Test No. 30, the Ti content was too high. For that reason, in the microstructure, $NT_L$NL in the L-direction observation field of view was less than 1.80, and $NT_C$/NC in the C-direction observation field of view was less than 1.70. As a result, the absorbed energy at −10° C. was less than 150 J, thus exhibiting poor low-temperature toughness.

In Test No. 31, the Nb content was too high. For that reason, in the microstructure, $NT_L$/NL in the L-direction observation field of view was less than 1.80, and $NT_C$/NC in the C-direction observation field of view was less than 1.70. As a result, the absorbed energy at −10° C. was less than 150 J, thus exhibiting poor low-temperature toughness.

In Test Nos. 32 and 33, although the content of each element in the chemical composition was appropriate, F2 did not satisfy Formula (2). For that reason, sufficient hot workability was not achieved.

In Test No. 34, although each element content in the chemical composition was appropriate, F1 did not satisfy Formula (1). For that reason, in the microstructure, $NT_L$/NL in the L-direction field of view was less than 1.80, and/or $NT_C$/NC in the C-direction observation field of view was less than 1.70. As a result, the absorbed energy at −10° C. was less than 150 J, thus exhibiting poor low-temperature toughness.

The embodiments of the present invention have been described so far. However, the embodiments described above are merely examples for carrying out the present invention. Therefore, the present invention will not be limited to the above described embodiments, and can be carried out by appropriately modifying the above described embodiments within a range not departing from the spirit thereof Industrial Applicability The seamless steel pipe of the present embodiment is widely applicable to applications where high strength and low-temperature toughness are required. The seamless steel pipe according to the present embodiment can be used as, for example, a steel pipe for geothermal power generation and a steel pipe for chemical plants. The seamless steel pipe according to the present embodiment is particularly suitable for oil well applications. Seamless steel pipes for oil well applications are, for example, casing pipes, tubing pipes, and drill pipes.

REFERENCE SIGNS LIST

1 Seamless steel pipe
10 Ferrite
20 Martensite
50 L-direction observation field of view
60 C-direction observation field of view
$T_L$1 to $T_L$4, $T_C$1 to $T_C$4 Line segments
L1 to L4, C1 to C4 Line segments
FB Ferrite interface
1L L-direction cross section
1C C-direction cross section

The invention claimed is:

1. A seamless steel pipe, comprising
a chemical composition consisting of:
in mass %,
C: 0.050% or less,
Si: 0.50% or less,
Mn: 0.01 to 0.20%,
P: 0.025% or less,
S: 0.0150% or less,
Cu: 0.09 to 3.00%,
Cr: 15.00 to 18.00%,
Ni: 4.00 to 9.00%,
Mo: 1.50 to 4.00%,
Al: 0.040% or less,
N: 0.0150% or less,
Ca: 0.0010 to 0.0040%,
Ti: 0.020% or less,
Nb: 0.020% or less,
V: 0 to 0.20%,
Co: 0 to 0.30%,
W: 0 to 2.00%, and
the balance: Fe and impurities, and satisfying Formulae (1) and (2), wherein
when a pipe axis direction of the seamless steel pipe is defined as an L direction, a wall thickness direction is defined as a T direction, and a direction perpendicular to the L direction and the T direction is defined as a C direction, a microstructure satisfies the following (I) to (III):
(I) The microstructure consists of, in total volume ratio, 80% or more of ferrite and martensite, with the balance being retained austenite;
(II) In an L-direction observation field of view of a square shape which is located at a center position of wall thickness of the seamless steel pipe, and whose side extending in the L direction is 100 μm long and whose side extending in the T direction is 100 μm long,
when four line segments which extend in the T direction and which are arranged at equal intervals in the L direction and divide the L-direction observation field of view into five equal parts in the L direction are defined as line segments $T_L$1 to $T_L$4,
four line segments which extend in the L direction and which are arranged at equal intervals in the T direction and divide the L-direction observation field of view into five equal parts in the T direction are defined as line segments L1 to L4, and
an interface between the ferrite and the martensite is defined as a ferrite interface,
a number of intersections $NT_L$, which is a number of intersections between the line segments $T_L$1 to $T_L$4 and the ferrite interface, is 38 or more, and
a number of intersections NL, which is a number of intersections between the line segments L1 to L4 and the ferrite interface, and the number of intersections $NT_L$ satisfy Formula (3);
(III) In a C-direction observation field of view of a square shape which is located at the center position of wall thickness of the seamless steel pipe, and whose side extending in the C direction is 100 μm long and whose side extending in the T direction is 100 μm long,
when four line segments which extend in the T direction and which are arranged at equal intervals in the C direction and divide the C-direction observation field of view into five equal parts in the C direction are defined as line segments $T_C$1 to $T_C$4, and four line segments which extend in the C direction and which are arranged at equal intervals in the T direction and divide the C-direction observation field of view into five equal parts in the T direction are defined as line segments C1 to C4, a number of intersections $NT_C$, which is the number of intersections between the line segments $T_C$1 to $T_C$4 and the ferrite interface, is 30 or more, and a number of intersections NC, which is the number of intersections between the line segments C1 to C4 and the ferrite interface, and the number of intersections $NT_C$ satisfy Formula (4):

$$156A1+18Ti+12Nb+11Mn+5V+328.125N+243.75C+12.5S\leq 12.5 \quad (1)$$

$$Ca/S\geq 4.0 \quad (2)$$

$$NT_L/NL\geq 1.80 \quad (3)$$

$$NT_C/NC\geq 1.70 \quad (4)$$

where, each symbol of element in Formulae (1) and (2) is substituted by the content (mass %) of a corresponding element.

2. The seamless steel pipe according to claim 1, wherein the chemical composition contains V: 0.01 to 0.20%.

3. The seamless steel pipe according to claim 2, wherein the chemical composition contains:

one or more types of element selected from the group consisting of

Co: 0.10 to 0.30%, and

W: 0.02 to 2.00%.

4. The seamless steel pipe according to claim 1, wherein the chemical composition contains:

one or more types of element selected from the group consisting of

Co: 0.10 to 0.30%, and

W: 0.02 to 2.00%.

5. A method for producing a seamless steel pipe, comprising:

a heating step for heating a starting material having a chemical composition consisting of, in mass %, C: 0.050% or less, Si: 0.50% or less, Mn: 0.01 to 0.20%, P: 0.025% or less, S: 0.0150% or less, Cu: 0.09 to 3.00%, Cr: 15.00 to 18.00%, Ni: 4.00 to 9.00%, Mo: 1.50 to 4.00%, Al: 0.040% or less, N: 0.0150% or less, Ca: 0.0010 to 0.0040%, Ti: 0.020% or less, Nb: 0.020% or less, V: 0 to 0.20%, Co: 0 to 0.30%, W: 0 to 2.00%, and the balance: Fe and impurities, and satisfying Formulae (1) and (2) at a heating temperature T of 1200 to 1260° C. for t hours;

a piercing-rolling step for piercing-rolling the starting material which has been heated in the heating step under a condition satisfying Formula (A) to produce a hollow shell;

a elongating-rolling step for elongating and rolling the hollow shell;

a quenching step for quenching the hollow shell after the elongating-rolling step at a quenching temperature of 850 to 1150° C.; and a tempering step for tempering the hollow shell after the quenching step at a tempering temperature of 400 to 700° C.:

$$156Al+18Ti+12Nb+11Mn+5V+328.125N+243.75C+12.5S\leq 12.5 \quad (1)$$

$$Ca/S\geq 4.0 \quad (2)$$

$$0.057X-Y<1720 \quad (A)$$

where, X in Formula (A) is defined by the following Formula (B):

$$X=(T+273)\times\{20+\log(t)\} \quad (B)$$

where, T is a heating temperature (° C.) of the starting material, and t is a holding time (hour) at the heating temperature T, an area reduction ratio Y (%) in Formula (A) is defined by Formula (C):

$$Y=\{1-(\text{cross sectional area perpendicular to pipe axis direction of hollow shell after piercing-rolling}/\text{cross sectional area perpendicular to pipe axis direction of starting material before piercing-rolling})\}\times 100 \quad (C).$$

6. The method for producing a seamless steel pipe according to claim 5, wherein the chemical composition contains V: 0.01 to 0.20%.

7. The method for producing a seamless steel pipe according to claim 6, wherein the chemical composition contains:

one or more types of element selected from the group consisting of

Co: 0.10 to 0.30%, and

W: 0.02 to 2.00%.

8. The method for producing a seamless steel pipe according to claim 5, wherein the chemical composition contains:

one or more types of element selected from the group consisting of

Co: 0.10 to 0.30%, and

W: 0.02 to 2.00%.

* * * * *